US010549902B1

(12) United States Patent
Brown, II et al.

(10) Patent No.: US 10,549,902 B1
(45) Date of Patent: Feb. 4, 2020

(54) BEVERAGE CONTAINER SYSTEM AND COMPONENTS

(71) Applicant: Benjamin Alexander Brown, II, Vero Beach, FL (US)

(72) Inventors: Benjamin Alexander Brown, II, Vero Beach, FL (US); Daniel Chambers, Houston, TX (US)

(73) Assignee: Benjamin Alexander Brown, II, Vero Beach, FL (US)

( * ) Notice: Subject to any disclaimer, the term of this patent is extended or adjusted under 35 U.S.C. 154(b) by 0 days.

(21) Appl. No.: 16/234,019

(22) Filed: Dec. 27, 2018

(51) Int. Cl.

| | |
|---|---|
| ***B65D 81/38*** | (2006.01) |
| ***B65D 43/02*** | (2006.01) |
| ***B65D 53/02*** | (2006.01) |
| ***A47G 19/22*** | (2006.01) |
| ***B65D 47/26*** | (2006.01) |

(52) U.S. Cl.
CPC ..... *B65D 81/3874* (2013.01); *A47G 19/2255* (2013.01); *A47G 19/2288* (2013.01); *B65D 43/022* (2013.01); *B65D 47/26* (2013.01); *B65D 53/02* (2013.01); *B65D 81/3869* (2013.01); *B65D 2543/00046* (2013.01)

(58) Field of Classification Search
CPC .. B65D 1/40; B65D 81/3874; B65D 81/3869; B65D 81/3865; B65D 81/38; B65D 81/3818; B65D 43/022; B65D 43/0214; B65D 43/0202; B65D 53/02; A47G 19/2255; A47G 19/2288; A47G 19/2272; A47G 19/2205
USPC ... 220/592.17, 592.16, 592.27, 592.2, 62.18, 220/62.17, 62.12, 62.11, 711, 625, 23.91, 220/23.89, 23.87, 739, 737
See application file for complete search history.

(56) References Cited

U.S. PATENT DOCUMENTS

| | | | | |
|---|---|---|---|---|
| 1,191,319 A * | 7/1916 | Kline | F25D 3/08 220/592.16 |
| 3,205,677 A | 9/1965 | Stoner | |
| 4,282,279 A | 8/1981 | Strickland | |
| 5,653,124 A | 8/1997 | Weber | |
| 6,102,244 A * | 8/2000 | Kuwano | A47G 19/2272 220/711 |
| 6,105,807 A | 8/2000 | McCrossen | |
| 6,119,889 A | 9/2000 | Fujii et al. | |
| 6,367,652 B1 | 4/2002 | Toida et al. | |

(Continued)

FOREIGN PATENT DOCUMENTS

| | | | |
|---|---|---|---|
| DE | 102014019509 A1 | 6/2016 | |
| EP | 431454 A1 * | 11/1990 | A47J 41/02 |

OTHER PUBLICATIONS

Translation of EP431454A1, Mothrath et al., Nov. 28, 1990, Fig. 2 (Year: 1990).*

(Continued)

*Primary Examiner* — Robert J Hicks
(74) *Attorney, Agent, or Firm* — Akerman LLP

(57) ABSTRACT

A beverage container system may include a vessel having an interior volume for containing a beverage and shell having an interior volume for removably coupling vessel therein. The vessel may include an inner wall, an outer sidewall, and a sealed volume between the inner wall and the outer wall. The sealed volume may be at a vacuum pressure. The vessel may be constructed from glass while the shell may be constructed from a durable material such as stainless steel.

20 Claims, 14 Drawing Sheets

(56) References Cited

U.S. PATENT DOCUMENTS

| | | | |
|---|---|---|---|
| 6,405,892 | B1 | 6/2002 | Volan |
| 7,104,413 | B2 | 9/2006 | Liu |
| 7,194,951 | B1 | 3/2007 | Porter |
| 7,306,113 | B2 | 12/2007 | Ed-Saden et al. |
| 9,452,876 | B2 | 9/2016 | Anelevitz et al. |
| 2016/0192797 | A1 | 7/2016 | Yang |
| 2017/0020318 | A1 | 1/2017 | Walker |

OTHER PUBLICATIONS

ONEISALL GYB0023 Leak-proof Glass lined Thermos Business Style Stainless Steel Travel Thermos Mug Vacuum Flask with Tea Strainer&Glass Liner, Heat Preservation Coffee Vacuum Cup, 320ML, Black, https://www.amazon.com/ONEISALL-Leak-proof-Business-Stainless-Preservation/dp/B01FSBY0FQ/ref=cm_cr_arp_d_product_top?ie=UTF8.

YETI Rambler 20 oz Stainless Steel Vacuum Insulated Tumbler w/MagSlider Lid, Black, https://www.amazon.com/Yeti-Rambler-Stainless-Insulated-MagSlider/dp/B073WJMKHN/ref=sr_1_3?keywords=tumbler&qid=1552075610&s=home-garden&sr=1-3.

Lifefactory 16-Ounce BPA-Free Glass Water Bottle with Classic Cap and Silicone Sleeve, Onyx, https://www.amazon.com/dp/B06XPBTCB7?aaxitk=J.vPyWFiQNTsQe4Vfsrk7w&pd_rd_i=B06XPBTCB7&pf_rd_p=e037c154-e093-48a4-b127-477e5e294ef&hsa_cr_id=8406398270301&sb-ci-n=asinimage&sb-ci-v=https%3A%2F%2Fimages-na.ssl-images-amazon.com%2Fimages%2FI%2F31BjVxCDZwL.jpg&sb-ci-a=B06XPBTCB7.

* cited by examiner

BEVERAGE CONTAINER SYSTEM AND COMPONENTS

TECHNOLOGY FIELD

The present description is directed to beverage containers. More specifically, the present description is directed to modular beverage containers and modular insulated beverage containers.

BACKGROUND

Beverage containers include vessels for holding and pouring beverages such as cups, glasses, tumblers, mugs, and goblets. Beverage containers may be specifically designed for particular activities such as sport water bottles or squirt bottles. Such containers may include a tightly sealable cap, squirt nozzle, or straw. Some beverage containers may be specifically designed for particular beverages such as wine glasses and coffee mugs. Coffee mugs are also an example of an insulated beverage container designed to limit heat transfer to maintain a temperature of a beverage. Other insulated beverage containers may include insulation between interior and exterior surfaces. One such example is a tumbler having a double wall vacuum seal. These tumblers are typically constructed from stainless steel due to its durability and ability to limit heat transfer in the double wall configuration.

SUMMARY

In one aspect, a modular beverage container system includes a vessel and a shell. The vessel may include an inner wall defining an interior volume for holding a beverage, an outer sidewall, and a sealed volume between the inner wall and the outer wall. The sealed volume may be at a vacuum pressure. The shell may include a sidewall defining an interior volume configured to receive the vessel and removably couple thereto.

In one embodiment, the shell and vessel each include a fitting configured to press fit with the other when the vessel is received within the interior volume of the shell to removably couple the vessel within the interior volume of the shell. In one example, one of the fittings comprises a hole and the other fitting comprises a projection dimensioned to press fit within the hole. In a further example, the vessel fitting may comprise a hole and the shell fitting may comprise a projection dimensioned to press fit within the hole.

The vessel may include an upper rim. When the vessel and shell are removably coupled, the upper rim may be positioned above an upper rim of the shell and outside of the interior volume of the shell. In one example, the upper rim includes an outer sidewall and the outer sidewall positions above the upper rim of the shell and outside of the interior volume of the shell when the vessel and shell are removably coupled. In a further example, the sidewall positions approximately flush with an outer sidewall of the shell when the vessel and shell are removably coupled. In another example, the upper rim includes a lip and the lip positions over an upper surface of the upper rim of the shell when the vessel and shell are removably coupled. The upper rim of the vessel may include an outer sidewall extending around the upper rim between an upper surface of the upper rim and the lip. When the vessel and shell are removably coupled, the outer sidewall may position approximately flush with an outer sidewall of the shell.

In various embodiments, the vessel and shell may be constructed from a material selected from one or more of a ceramic, non-metallic ceramic, glass-ceramic, polymer, plastic, silicone, thermoplastic, polymer glass such as a polycarbonate, acrylic, or polyethylene terephthalate, metal, metallic, such as steel or stainless steel, rock, artificial stone, or combination or composite thereof. The vessel may comprise a different material or a same material as the shell. In one example, the vessel may comprise a glass and the shell may comprise stainless steel.

In one embodiment, the modular beverage container system includes a lid configured to removably couple over the interior volume of the vessel. In one example, the lid includes a fitting configured to press fit against an inner sidewall of the vessel to removably couple within the interior volume of the vessel. In a further example, the lid and vessel may each include an upper rim having an upper surface. When the lid is removably coupled within the interior volume the vessel, the upper surface of the upper rim of the lid may position approximately flush with or below the upper surface of the upper rim of the vessel.

In another aspect, a method of assembling a modular beverage container may include inserting a vessel within an interior volume of a shell. The vessel and shell may each include a fitting configured to press fit with the other. The method may further include removably coupling the vessel within the interior volume of the shell by press fitting the corresponding fittings of the vessel and shell. The vessel may include an inner wall defining an interior volume for holding a beverage, an outer sidewall, and a sealed volume between the inner wall and the outer wall, wherein the sealed volume is at a vacuum pressure.

In one embodiment, one of the fittings comprises a hole and the other fitting comprises a projection dimensioned to press fit within the hole. In some embodiments, the vessel has an upper rim including an outer sidewall and the outer sidewall positions above an upper rim of the shell and outside of the interior volume of the shell when the vessel and shell are removably coupled. In one example, the upper rim of the vessel includes a lip and the lip positions over an upper surface of the upper rim of the shell and the outer sidewall positions approximately flush with an outer sidewall of the shell when the vessel and shell are removably coupled.

In one embodiment, the method may further include inserting a lid within the interior volume of the vessel and removably coupling the lid therein. The lid and vessel may each include an upper rim having an upper surface. When the lid is removably coupled within the interior volume of the vessel, the upper surface of the upper rim of the lid may position approximately flush with or below the upper surface of the upper rim of the vessel.

In another aspect, a modular beverage container system includes a vessel comprising an inner wall, an outer sidewall, an upper rim having an outer sidewall, and a sealed volume between at least the inner wall and the outer wall. The vessel may comprise a material selected from one or more of a ceramic, non-metallic ceramic, glass-ceramic, polymer, plastic, silicone, thermoplastic, polymer glass such as a polycarbonate, acrylic, or polyethylene terephthalate, metal, metallic, such as steel or stainless steel, rock, artificial stone, or combination or composite thereof. In one example, the vessel comprises a glass vessel. The sealed volume may be maintained at a vacuum pressure. The inner wall and upper rim may define an interior volume for holding a beverage. The modular beverage container may further include a rigid shell comprising a sidewall including an upper rim and defining an interior volume therebetween configured to receive the vessel and removably couple thereto. The shell may comprise a material selected from one or more of a ceramic, non-metallic ceramic, glass-ceramic, polymer, plastic, silicone, thermoplastic, polymer glass such as a polycarbonate, acrylic, or polyethylene terephthalate, metal, metallic, such as steel or stainless steel, rock, artificial stone, or combination or composite thereof. The shell and vessel may each include a fitting configured to press fit with the other when the vessel is received within the interior volume of the shell to removably couple the vessel within the interior volume of the shell. When the vessel and shell are removably coupled, the outer sidewall of the upper rim of the vessel may position above the upper rim of the shell and approximately flush with an outer sidewall of the shell.

In various embodiments, the modular beverage container system may also include a lid configured to removably couple within the interior volume of the vessel. The lid may comprise an upper rim having an upper surface. When the lid is removably coupled within the interior volume of the vessel, the upper surface of the upper rim of the lid may position approximately flush with or below the upper surface of the upper rim of the vessel.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

DESCRIPTION

Figure 1:
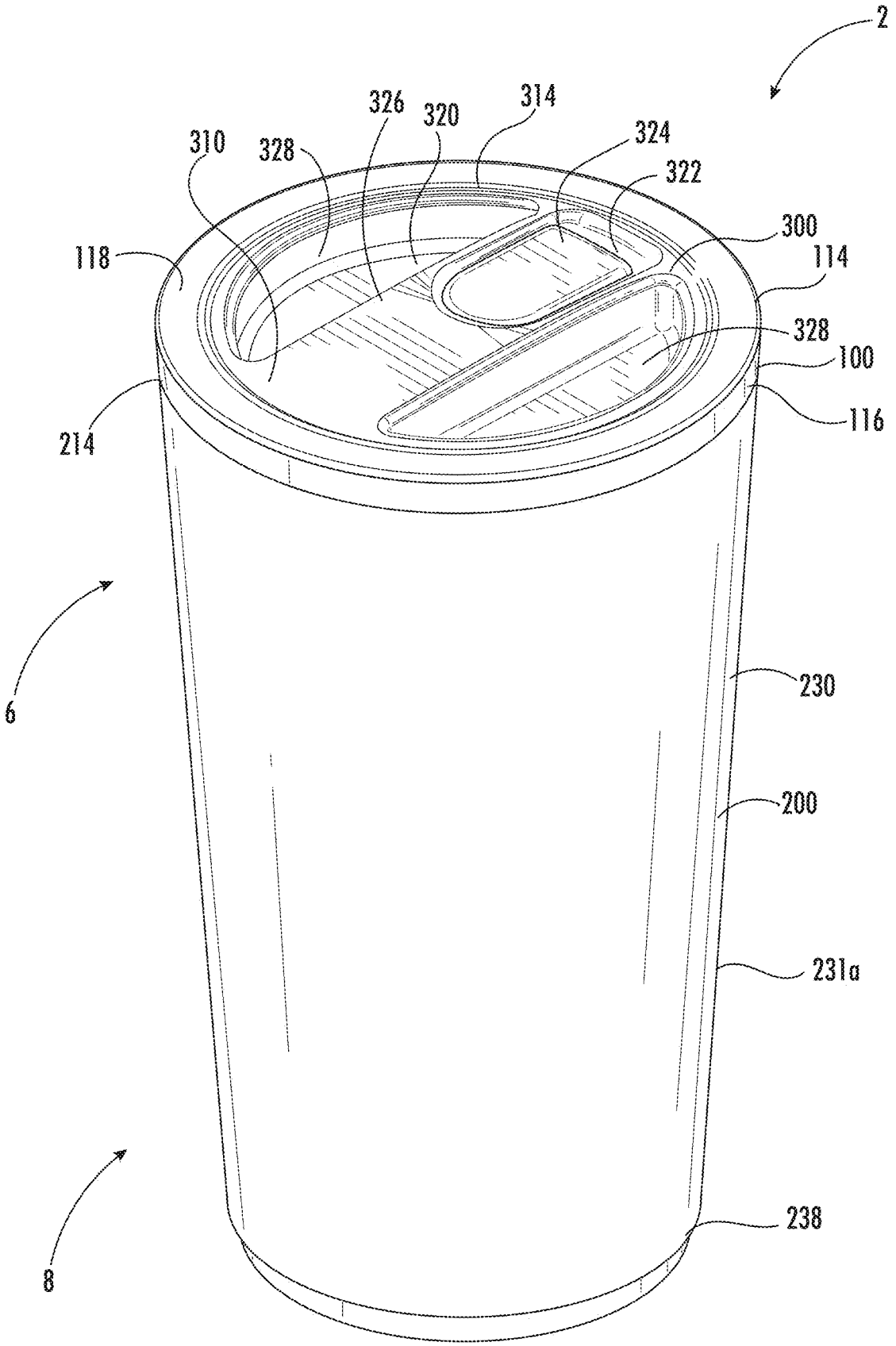
FIG. 1 is a perspective view of an assembled modular beverage container system according to various embodiments described herein.

The present disclosure describes improved beverage container systems and components thereof that address various practical limitations that exist with current beverage containers. Some embodiments may further include insulated beverage container systems and components thereof that address limitations that exist with current insulated beverage containers. These or further embodiments may include modular beverage container systems and components thereof.

Stainless steel, while durable, cost-effective, and capable of providing a level of insulation for many applications, is not an ideal material to drink from in terms of flavor. For example, many popular beverages such as coffee, tea, beer, wine, liquor, and juice are acidic; however, stainless steel reacts with acids, which may corrode the passive layer of a stainless steel vessel, imparting a metallic taste.

Unlike metals and plastics, which may leach chemicals, glass does not chemically react with potable liquids in a significant way. Accordingly, glass does not notably interfere with taste of a beverage. One drawback of glass, however, is that glass typically has inferior durability and is susceptible to fracture.

According to various embodiments, the teachings of the present disclosure may be used to incorporate a vessel with a durable outer shell. In some embodiments, the vessel may comprise a glass to thereby incorporate the superior drinking surface of glass within a protective shell. The shell may be constructed of a rigid material such as a metal or alloy, e.g., steel, to protect the vessel. Thus, the shell design may be used to mitigate durability disadvantages associated with the construction material of the vessel. In one example, the vessel may comprise a double wall vacuum construction. In any of the above or another example, the vessel may comprise a modular liner configured to be received within the shell. For example, the shell and vessel may form a modular beverage container system wherein the shell and vessel may be removably coupled. For instance, the vessel may be securely received within the shell and thereafter be suitably removable therefrom during normal operation of the system without damaging the shell or vessel. In addition to improving drinking characteristics, the modular design provides a user an ability to remove the vessel and place it in a dishwasher, microwave, or freezer, which is a limitation of existing stainless steel tumblers. It will be appreciated that beverage container systems and components described herein may include materials other than glass and stainless steel. For example, various embodiments may include a vessel or shell comprising one or more of a ceramic, non-metallic ceramic, glass-ceramic, polymer, plastic, silicone, thermoplastic, polymer glass such as a polycarbonate, acrylic, or polyethylene terephthalate, metal, metallic, such as steel or stainless steel, rock, artificial stone, or combination or composite thereof. In one example, the shell comprises wood.

FIGS. 1-14 illustrate various exemplary embodiments and features of a modular beverage container system 2 according to various wherein like numbers refer to like features. The modular beverage container system 2 shown in the drawings includes a modular configuration; however, it is to be understood that some embodiments may include one or more of such modular components combined as a unitary component or may exclude one or more such components.

FIG. 1 illustrates an embodiment of the modular beverage container system 2 in an assembled configuration. The modular beverage container system 2 includes a vessel 100 and a shell 200. The vessel 100 defines an interior volume 110 (see, e.g., FIG. 8) configured to hold a liquid. The shell 200 may also define an interior volume 210 (see, e.g., FIG. 4) dimensioned to receive the vessel 100 therein. The vessel 100 includes an upper rim 114 defining an opening 115 (see, e.g., FIG. 2) into the interior volume 110 of the vessel 100. The shell 200 similarly includes an upper rim 214 defining an opening 215 into the interior volume 210 of the shell 200.

In the embodiment shown in FIG. 1, the upper rim 114 positions above an upper rim 214 of the shell 200, exposing a sidewall 116 of the upper rim 114 along an upper end 6 of the modular beverage container system 2 in an assembled configuration. In some embodiments, the upper rim 114 of the vessel 100 may extend level with or below the upper rim 214 of the shell 200.

In various embodiments, the modular beverage container system 2 includes a lid 300. The lid 300 may be configured to be modular with respect to the vessel 100 and shell 200 and to be removably coupled over the interior volume 110 of the vessel 100. In the embodiment shown in FIG. 1, the lid 300 positions within the upper rim 114 of the vessel 100, relatively flush with an upper surface 118 thereof. As described in more detail below, some embodiments may include other lid 300 configurations, such as those wherein the lid 300 extends over the upper rim 114 of the vessel 100 and/or the upper rim 214 of the shell 200, or upper surfaces 118, 218 thereof, when the modular beverage container system 2 is in an assembled configuration. In some examples, the lid 300 may position above or below the upper rim 114 of the vessel 100.

In various embodiments, the lid 300 may include a partition wall 320 defining an opening 322 through which liquid may flow into or out of the interior volume 110 of the vessel 100. The lid 300 may also include a cap 324 that is positionable over or through the opening 322 to prevent passage of liquid through the opening 322. In some embodiments, however, the lid 300 does not include a cap 324.

In some embodiments, the lid 300 may also includes a grip 326. The grip 326 may be dimensioned to be gripped by a user to allow the user to manipulate the lid 300. The grip 326 may include one or more slots 328 into which a user may position one or more fingers to push, pull, or rotate the lid 300. For example, a user may position fingers in slots 328 and therein compress the lid 300 between the slots 328 to obtain leverage to lift the lid 300. In various configurations, the lid 300 may include a grip 326 including indentations, projections, or other surface features onto which fingers of a user may engage to assist in manipulation of the lid 300. In some embodiments, the grip 326 may include a coating or outer skin, e.g., a silicone or an elastomer. The coating or outer skin may assist a user in gripping the lid 300, e.g., the coating or outer skin may be textured or ergonomically dimensioned to aid in grip.

The modular beverage container system 2 depicted in FIG. 1 has a generally cylindrical profile shape that tapers from the upper end 6 toward a lower end 8. The modular beverage container system 2 also includes an annular horizontal cross-section shape having an increasing diameter from the lower end 8 to the upper end 6. In other embodiments, the modular beverage container system 2, e.g., vessel 100, shell 200, lid 300, or a combination thereof may include other profiles and/or cross-section shapes. For example, the modular beverage container system 2 may have a profile shape including straight or curved sides. Curves, for example, may curve outward from the lower end 8 toward the upper end 6. In some examples, the profile shape may taper at one or more points from the upper end 6 to the lower end 8. In various embodiments, the profile shape may include multiple tapered regions that taper at the same or different rates or degrees. In another example, the modular beverage container system 2 may have a profile shape that includes straight sides without tapering. Various embodiments of the modular beverage container system 2 may also include cross-section shapes such as annular or multisided geometric or non-geometric shapes.

Figure 2:
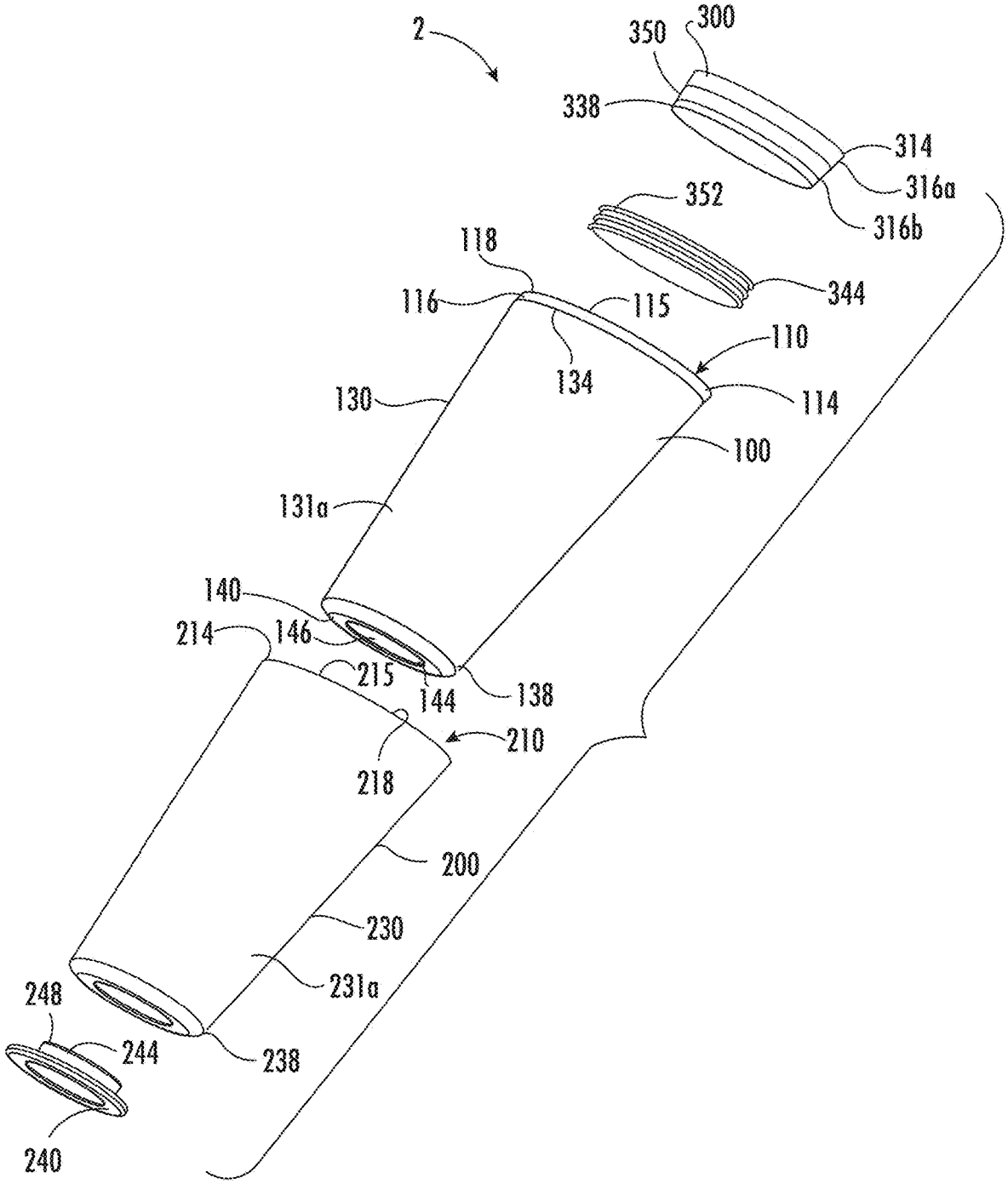
FIG. 2 is an exploded view of a modular beverage container system according to various embodiments described herein.
Figure 3:
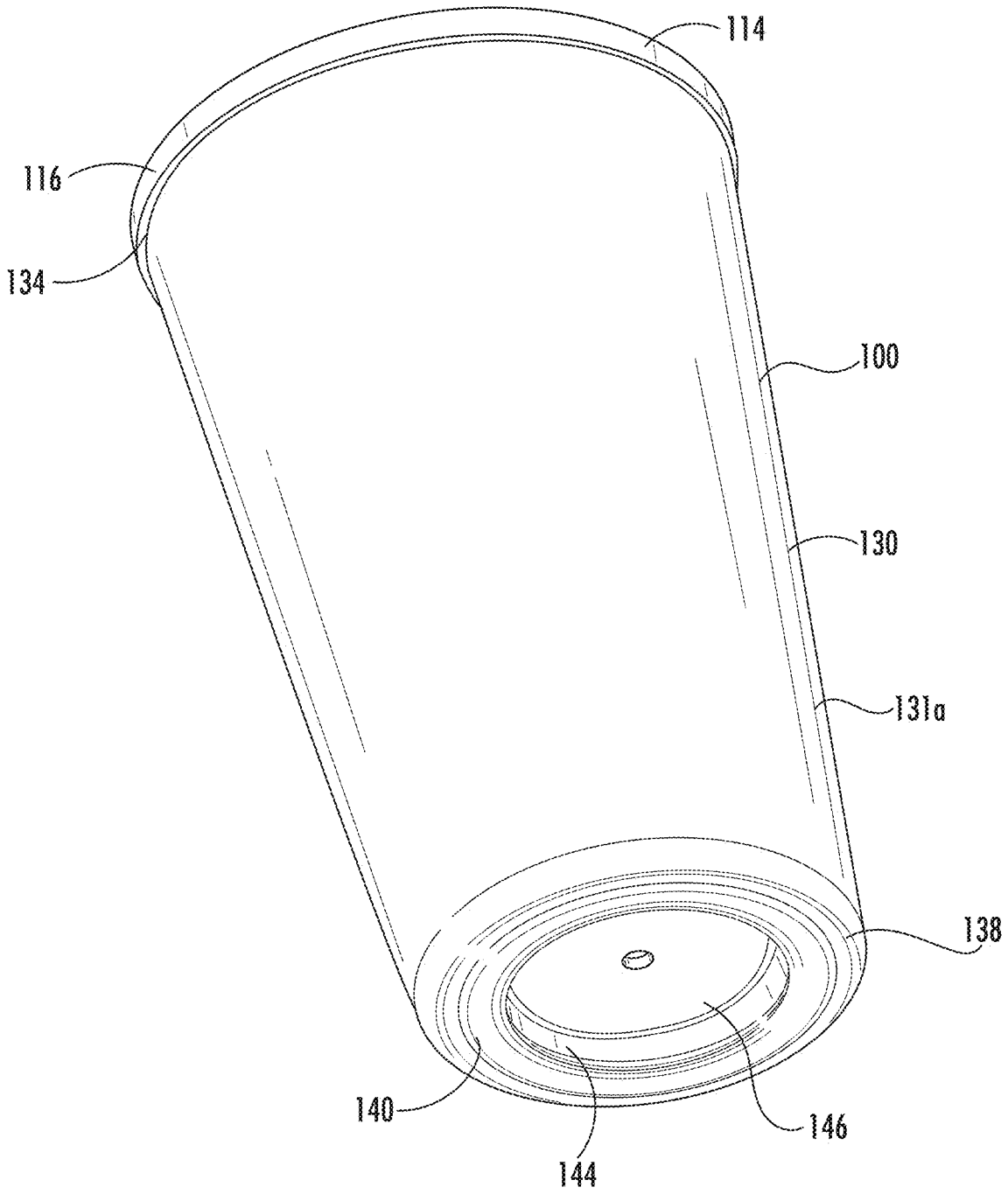
FIG. 3 is a perspective view of a vessel of a modular beverage container system according to various embodiments described herein.
Figure 4:
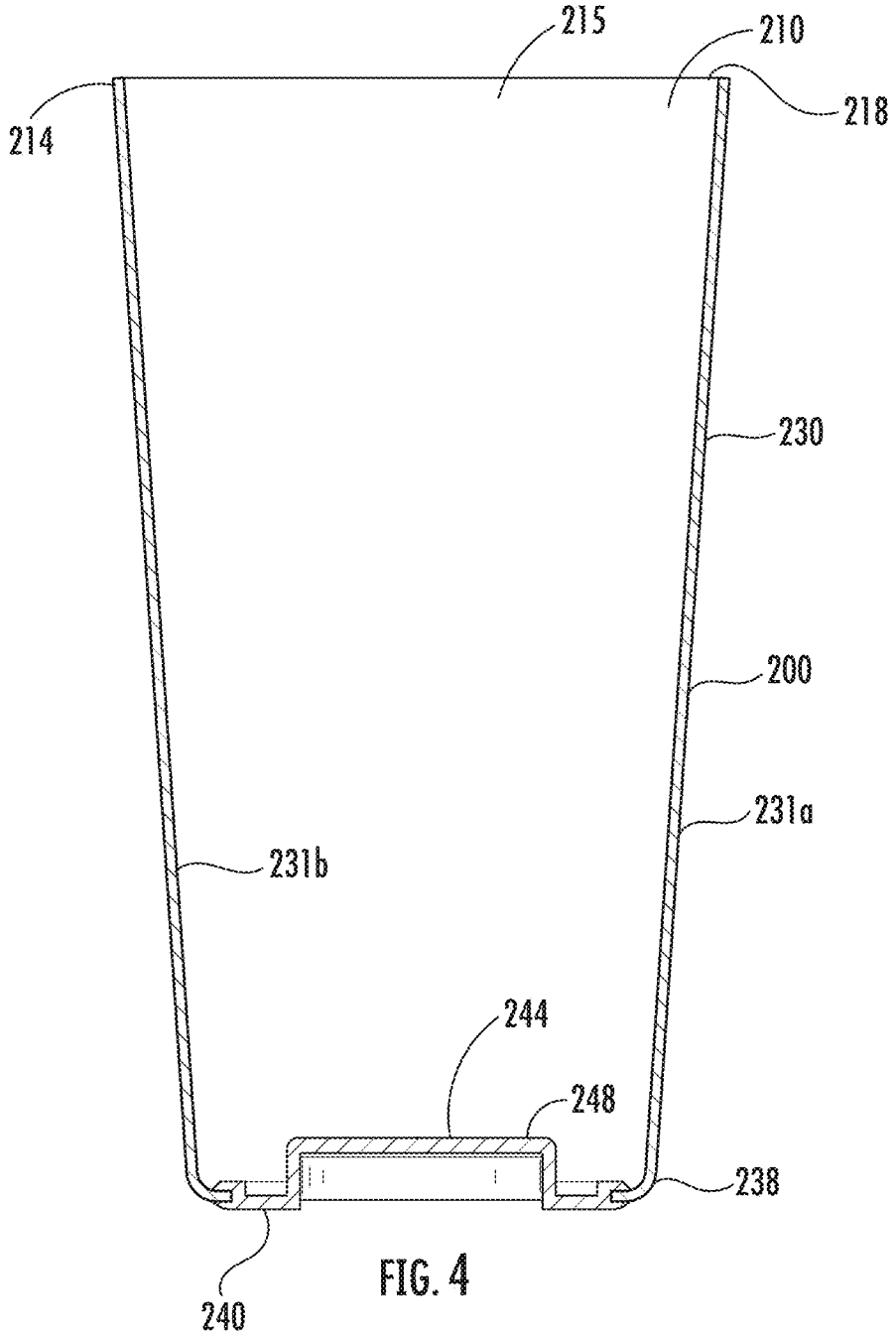
FIG. 4 is a cross-section view of a shell of a modular beverage container system according to various embodiments described herein.
Figure 5:
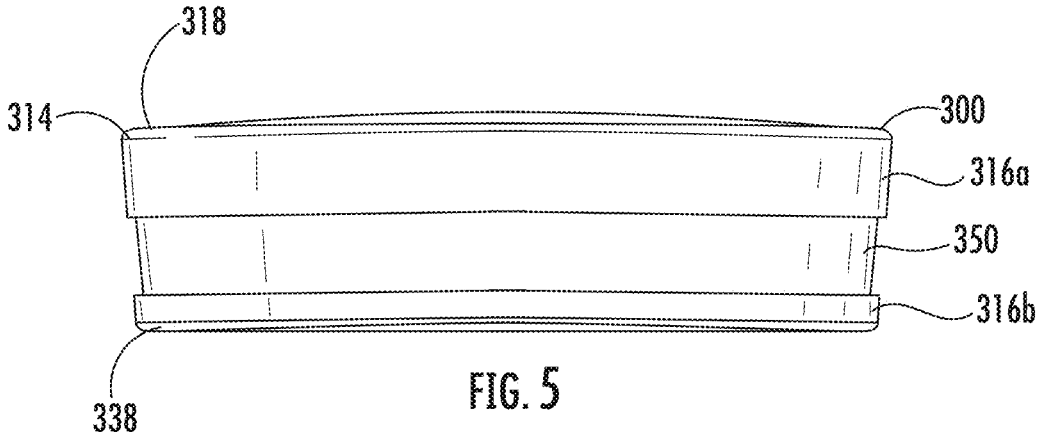
FIG. 5 is an orthogonal view of a lid for a modular beverage container system according to various embodiments described herein.
Figure 6:
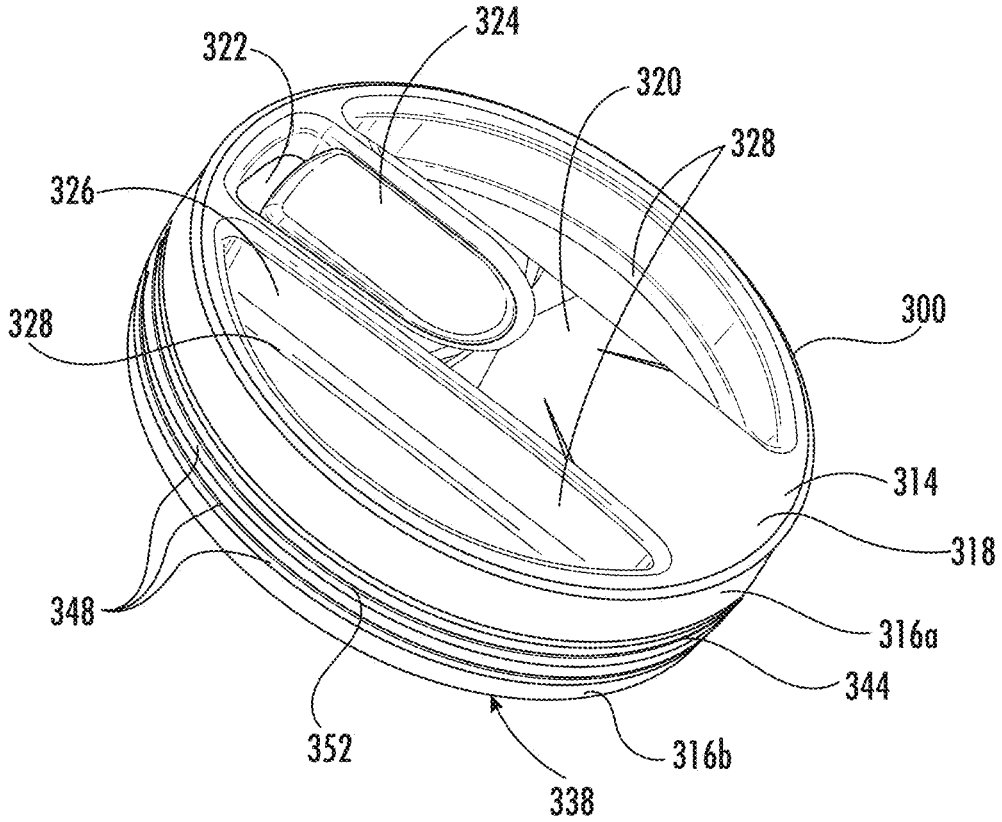
FIG. 6 is a perspective view of an upper end of a lid according to various embodiments described herein.

FIG. 2 depicts an exploded view of the assembled modular beverage container system 2 shown in FIG. 1 and illustrates modularity features of the vessel 100 and shell 200 according to various embodiments. FIG. 3 illustrates an isolated view in perspective of the vessel 100, while FIG. 4 illustrates a cross-section view of the shell 200. FIG. 5 illustrates a side view of the lid 300, and FIG. 6 illustrates a perspective view of the lid 300.

With specific reference to FIGS. 2 & 3, the vessel 100 may include one or more walls 130 extending between the upper rim 114 and a lower rim 138. The one or more walls 130 includes an outer sidewall 131*a* and an inner sidewall 131*b*. The inner sidewall 131*b* may at least partially define the interior volume 110 of the vessel 100. The lower rim 138 may extend to a base 140. The upper rim 114 may include a lip 134 that projects outwardly beyond an adjacent lower portion of the wall 130. For example, the upper rim 114 may comprise a flange that extends outward beyond the wall 130. The upper rim 114 may also include a perimeter edge, referred to herein as upper sidewall 116. As introduced above with respect to FIG. 1, the modular beverage container system 2 may be configured such that the upper sidewall 116 is exposed when the modular beverage container system 2 is in an assembled configuration. However, in other embodiments, the upper sidewall 116 may not be exposed when the modular beverage container system 2 is in an assembled configuration.

The vessel 100 may include single or multiwall configurations, such as a double wall configuration, e.g., as described below with respect to FIGS. 7-9. A multiwall configuration may further include insulation between walls. For example, vacuum insulation comprising a vacuum pressure maintained between two or more of the walls may be used to insulate the interior volume. Other insulating materials could also be used between walls such as plastics, foam, cellulose, glass, ceramics, or stone, for example.

In various embodiments, the vessel 100 may comprise glass, such as a silicate glass. In one embodiment, the vessel 100 comprises a borosilicate glass. While the properties of glass may offer a preferred balance of characteristics, particularly when protected by a durable, rigid shell 200, in some embodiments, the vessel 100 may be constructed from other materials, either together with or instead of glass. For example, in one embodiment, the vessel 100 comprises one or more of a ceramic, non-metallic ceramic, glass-ceramic, polymer, plastic, silicone, thermoplastic, polymer glass such as a polycarbonate, acrylic, or polyethylene terephthalate, metal, metallic, such as steel or stainless steel, rock, artificial stone, or combination or composite thereof. The beverage container systems and components are typically sized for personal use or to hold a common volume of liquid for a personal beverage container such as 12 oz., 20 oz., 32 oz., or 40 oz., for example. However, the vessel 100 and shell 200 are not limited to such sizes.

In various embodiments, the shell 200 and/or vessel 100 may comprise one or more fittings 144, 244 configured to removably couple the shell 200 and vessel 100. In the embodiment illustrated in FIGS. 2 & 3, the vessel 100 includes a fitting 144 comprising a hole 146 defined in the base 140. The base 140 and/or fitting 144 may comprise the same material as the wall 130 or may be made of a different material. For example, the base 140 may comprise the same material as the wall 130 and lower rim 138 and be continuous therewith. In another example, the base 140 may be attached to the lower rim 138 by adhesive or may be over molded with a portion of the lower rim 138 and/or a sub-base extending across the cross-section defined by the lower rim 138.

With further reference to FIG. 4, the shell 200 may include one or more walls 230 extending between the upper rim 214 and a lower rim 238. The wall 230 may include an outer sidewall 231*a* and an inner sidewall 231*b*. The inner sidewall 231*b* may define an interior volume 210 dimensioned to removably receive the vessel 100. The outer sidewall 231*a* may form an exterior surface of the shell 200, which may be used by a user to grip or hold the shell 200 or modular beverage container system 2. A base 240 may form a bottom end of the shell 200 and extend between the lower rim 238.

The shell 200 preferably comprises a durable material, which may also be rigid, suitable to protect the vessel 100 when received within the shell 200. In one example, the shell 200 is constructed from stainless steel. In various embodiments, other materials may be used such as one or more of a ceramic, non-metallic ceramic, glass-ceramic, polymer, plastic, silicone, thermoplastic, polymer glass such as a polycarbonate, acrylic, or polyethylene terephthalate, metal, metallic, such as steel or stainless steel, rock, artificial stone, or combination or composite thereof. In some embodiments, the base 240 may include a coating or outer skin along outer sidewall 231*a*. The coating or outer skin may include a silicone or an elastomer for example. The coating or outer skin may assist a user in gripping the shell 200, e.g., the coating or outer skin may be textured or ergonomically dimensioned to aid in grip. In one example, the shell 200 includes a handle extending from wall 230.

The base 240 includes a fitting 244 configured to removably couple the vessel 100. The fitting 244 illustrated includes a projection 248 extending from the base 240. The projection 248 may have dimensions corresponding to the dimensions of hole 146 and may include a slightly larger dimension to provide a tight or interference fit with the hole 146.

The base 240 and/or fitting 244 may comprise the same material as the wall 230 or may be constructed from a different material. For example, in one embodiment, the base 240 may comprise the same material as the wall 230 and lower rim 238 and be continuous therewith. In another example, the base 240 may be attached to the lower rim 238 by adhesive or may be over molded with a portion of the lower rim 238 and/or a sub-base extending across the cross-section defined by the lower rim 238. In the example shown in FIGS. 2 & 4, the base 240 of the shell 200 comprises an elastomeric material comprising a silicone base 240 that is over molded with respect to the lower rim 238.

The interior volume 210 may be sealed along the wall 230 and base 240. In some embodiments, the interior volume 210 may include one or more openings along the wall 230 or base 240. For example, an opening may be provided through the wall 230 or base 240 to allow atmosphere to move into or out of the interior volume 240 during assembly/coupling or disassembly/uncoupling. In some embodiments, an opening may be selectively opened and closed, e.g., via removal of a plug or opening of a valve.

In various embodiment wherein the modular beverage container system 2 comprises a fitting configured for press fitment, at least one of a hole, such as hole 146, or a projection, such as projection 248, includes a resiliently compressible and/or elastomeric material that may be resiliently compressed or stretched to thereafter provide a friction fit with respect to the other.

In some embodiments, hole 146, projection 248, or both comprises tapered sides or cross-sections. For example, the hole 146 may include an opening profile that tapers inwardly, into the hole 146, and/or the projection 248 may include a profile that tapers outwardly. A tapered configuration may ease initial lining up and pressing of the projection 248 into the hole 146 when the initial cross-section of the hole 146 is greater than the initial cross-section of the projection 248 with respect to an insertion sequence for press fitting the two. In other embodiments, the sides of the hole 146, projection 248, or both are not tapered.

With continued reference to FIGS. 2-4, the vessel 100 and shell 200 may be removably coupled by inserting the vessel 100 into the interior volume 210 of the shell 200 and pressing the projection 248 into hole 146. The corresponding fittings 144, 244 and walls 130, 230 may be dimensioned such that an upper surface 218 of the upper rim 214 of the shell 200 engages the lip 134 of the upper rim 114 of the vessel 100 when a suitable press fit has been achieved. As described above and elsewhere herein, in some examples, the upper rim 114 of the vessel 100 does not include a lip 134 and the upper rim 114 may position above, approximately flush with, or below an upper surface 218 of the upper rim 214 of the shell 200 in an assembled configuration. When the upper rim 114 of the vessel 100 positions above the upper rim 214 of the shell 200, the upper rim 114 of the vessel 100 may provide a region upon which a user may grip the vessel 100 during coupling and uncoupling of the vessel 100 and the shell 200. In some such embodiments, the upper rim 114, e.g., upper surface 118 and/or sidewall 116, may be contoured to provide better grip. In this or another example, the upper rim 114 of the vessel 100 may extend outwardly beyond the upper rim 214 of the shell 200 when the vessel 100 and shell 200 are removably coupled in an assembled configuration.

With particular reference to FIGS. 2, 5 & 6, the lid 300 may include an upper rim 314 and a lower rim 338. One or more sidewalls 316*a*, 316*b* may extend between the upper rim 314 and lower rim 338. As introduced above, assembling the modular beverage container system 2 may include removably coupling the lid 300 over the interior volume 110 of the vessel 100. Accordingly, various embodiments of the lid 300 may include a fitting 344 configured to assist in removably coupling the lid 300 over the interior volume 110 of the vessel 100. For example, the lid 300 may include a fitting 344 comprising an outer perimeter having a cross-section slightly larger than a cross-section of an interior perimeter of the vessel 100. The outer perimeter may comprise a resiliently compressible material configured to assist in a friction fit to thereby press fit the fitting 344 within the smaller cross-section of an interior perimeter of the interior volume 110 defined by the inner sidewall 131*b* of the vessel 100. In some embodiments, the interior perimeter of the vessel 100 along the inner sidewall 131*b*, the outer perimeter of the fitting 344, or both may include a cross-section that tapers such that the cross-section along a lower portion of the fitting 344 is smaller than a cross-section along an upper portion of the interior perimeter of the interior volume defined by the inner sidewall 131*b* to assist in guiding and thereby compressing the fitting 344 against the sidewall 130 within a smaller lower portion of the interior perimeter of the interior volume defined by the inner sidewall 131*b*.

In the embodiment illustrated in FIGS. 2 & 6, the fitting 344 comprises one or more projections 348 defining an outer perimeter of the lid 300. The projections 348 are configured to compress against the interior perimeter of the inner sidewall 131*b* when inserted therebetween. The projections 348 may comprise a resiliently compressible elastomeric material such as silicone configured to provide a friction fit when compressed against the inner sidewall 131*b*. The projections 348 may be integral or modular with respect to the lid 300. In the illustrated embodiment, and as most clearly depicted in FIG. 5, the lid 300 may define a perimeter groove 350 that opens outwardly and extends around the lid 300 between an upper sidewall 316*a* and a lower sidewall 316*b*. As further shown in FIG. 2, the fitting 344 may also include a seal gasket 352, which is modular in this embodiment (see also FIG. 13). The seal gasket 352 includes three annular projections 348 and is dimensioned to be securely positionable within the groove 350 to extend along the outer perimeter of the lid 300 (see FIG. 6) and therefrom engage the inner sidewall 131*b* along the interior perimeter of the interior volume 110 to provide a seal therebetween when the fitting 344 is compressed against the sidewall 131*b* of wall 130. The outer perimeter of the lid 300 tapers from the upper sidewall 316*a* toward the lower sidewall 316*b*. In one embodiment, the lid 300 does not taper.

As introduced above, the vessel 100 may have a single or multiwall configuration. FIG. 7 illustrates a cross-section of an example of the vessel 100 wherein the vessel 100 has a multiwall configuration. In particular, the wall 130 includes an inner or first wall 130*a* that defines at least a portion of the interior volume 110 of the vessel 100 and an outer or second wall 130*b* that may define a portion of the outer profile of the vessel 100 wherein the first wall 130*a* is positioned interiorly of the second wall 130*b*. The first wall 130*a* may extend between the upper rim 114 and a vessel floor 156. The second wall 130*b* may extend between the upper rim 114 and the lower rim 138. The upper rim 114 of the vessel 100 may comprise a solid material, such as a glass, e.g., as shown in the drawings, or may include a portion of the vacuum sealed space 158. As described above, the upper rim 114 may include an upper sidewall 116 and a lip 134 that extends around an outer perimeter of the second wall 130*b*. The lower rim 138 may extend to a base 140. The base 140 may include a fitting 144. In this embodiment, the fitting 144 comprises a hole 146 defined in the base 140, as described above with respect to FIG. 2. The first and second walls 130*a*, 130*b* may taper from the upper rim 114 to the lower rim 138.

The first wall 130*a* includes an inner sidewall 131*b* that at least partially defines the interior volume 110 and an outer sidewall 132*a*. The second wall 130*b* includes and inner sidewall 132*b* and an outer sidewall 131*a*. The outer sidewall 131*a* is the outermost wall and may form a portion of the profile shape of the vessel 100. Insulation may be positioned between the first and second walls 130*a*, 130*b*. For example, a sealed volume 158 is positioned at least partially between the first and second walls 130*a*, 130*b*. As shown, the outer sidewall 132*a* of the first wall 130*a* and the inner sidewall 132*b* of the second wall 130*b* at least partially define the sealed volume 158. In various embodiments, the sealed volume 158 may be an insulation volume to prevent conduction or heat transfer between the walls 130*a*, 130*b*. In one example, the sealed volume 158 may be maintained at a vacuum pressure. In the illustrated embodiment, the base 140, vessel floor 156, lower rim 138, upper rim 114, and first and second walls 130*a*, 130*b* together define the sealed volume 158. In this embodiment, the first and second walls 130*a*, 130*b*, upper and lower rim 138, fitting 144, and vessel floor 156 comprise borosilicate glass. However, in other embodiments, other glasses or materials, including composites, may be used, such as those described above with respect to FIGS. 2 & 3 and elsewhere herein may be used.

Figure 7:
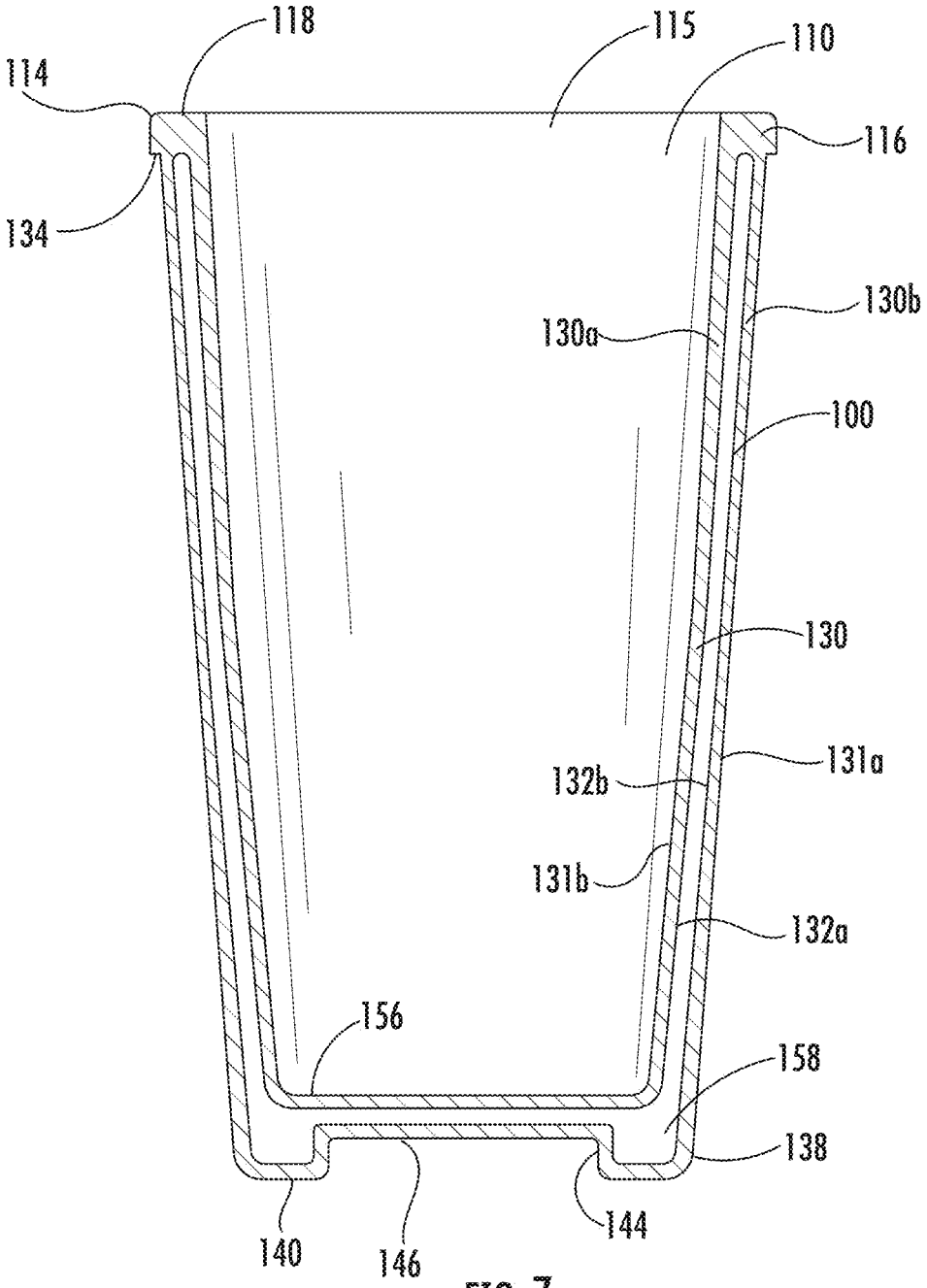
FIG. 7 is a cross-section view of a vessel of a modular beverage container system having a double wall configuration according to various embodiments described herein.
Figure 8:
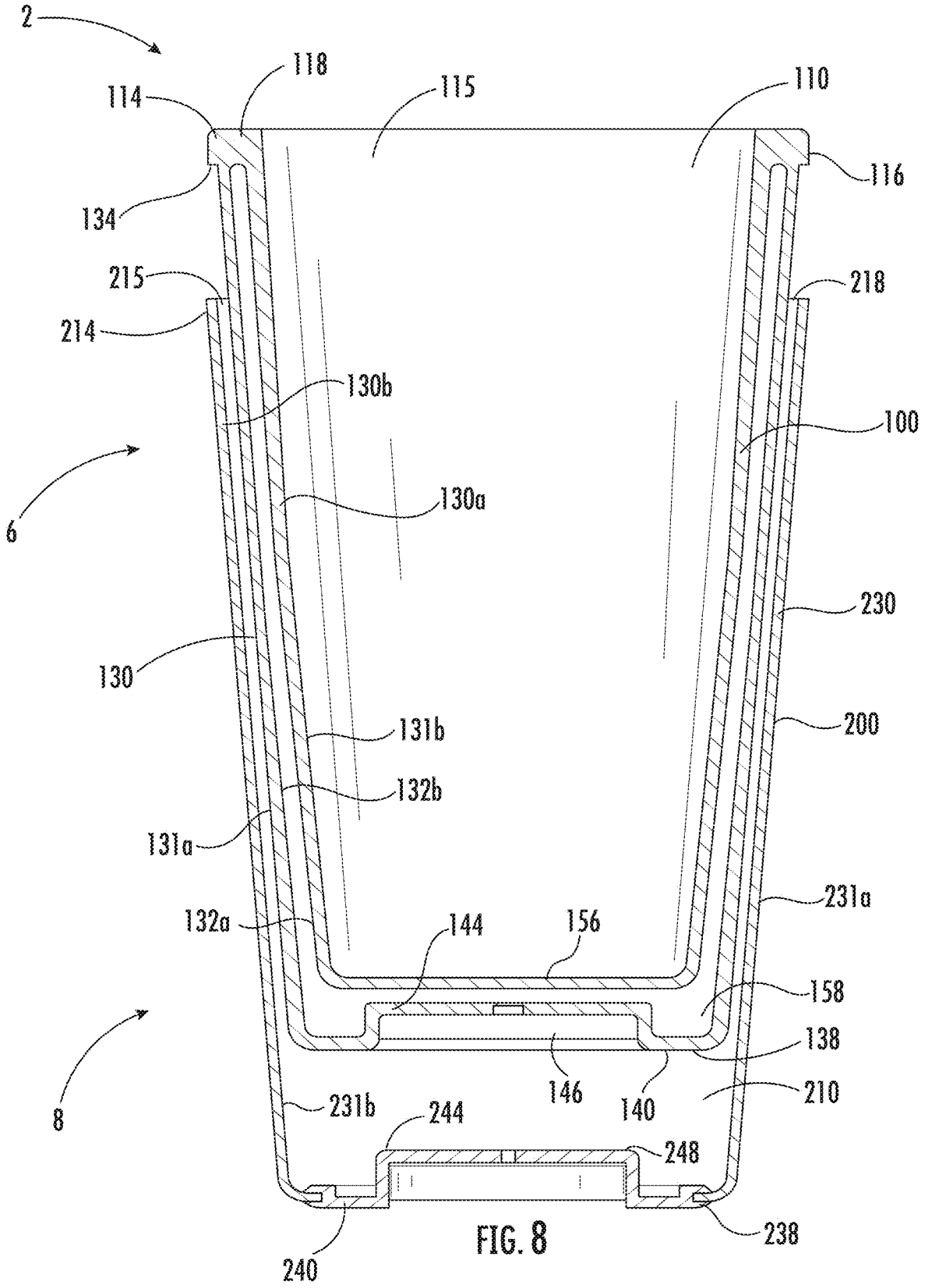
FIG. 8 is a cross-section view of the assembly/disassembly of the shell and vessel of FIG. 9 according to various embodiments described herein.

FIG. 8 illustrates an intermediate assemble/disassembly of the vessel 100 shown in FIG. 7 and the shell 200 shown in FIG. 4. The vessel 100 and shell 200 may be removably coupled by inserting the vessel 100 into the interior volume 210 of the shell 200 and pressing the projection 248 into hole 146. As noted above, the corresponding fittings 144, 244 and walls 130, 130*a*, 130*b*, 230 may be dimensioned such that the upper rim 214 of the shell 200 engages the lip 134 of the upper rim 114 of the vessel 100 when a suitable press fit has been achieved. In other embodiments, the vessel 100 and shell 200 may be press fit prior to the upper rim 214 of the shell 200 engaging the lip 134 of the upper rim 114 of the vessel 100.

Figure 9:
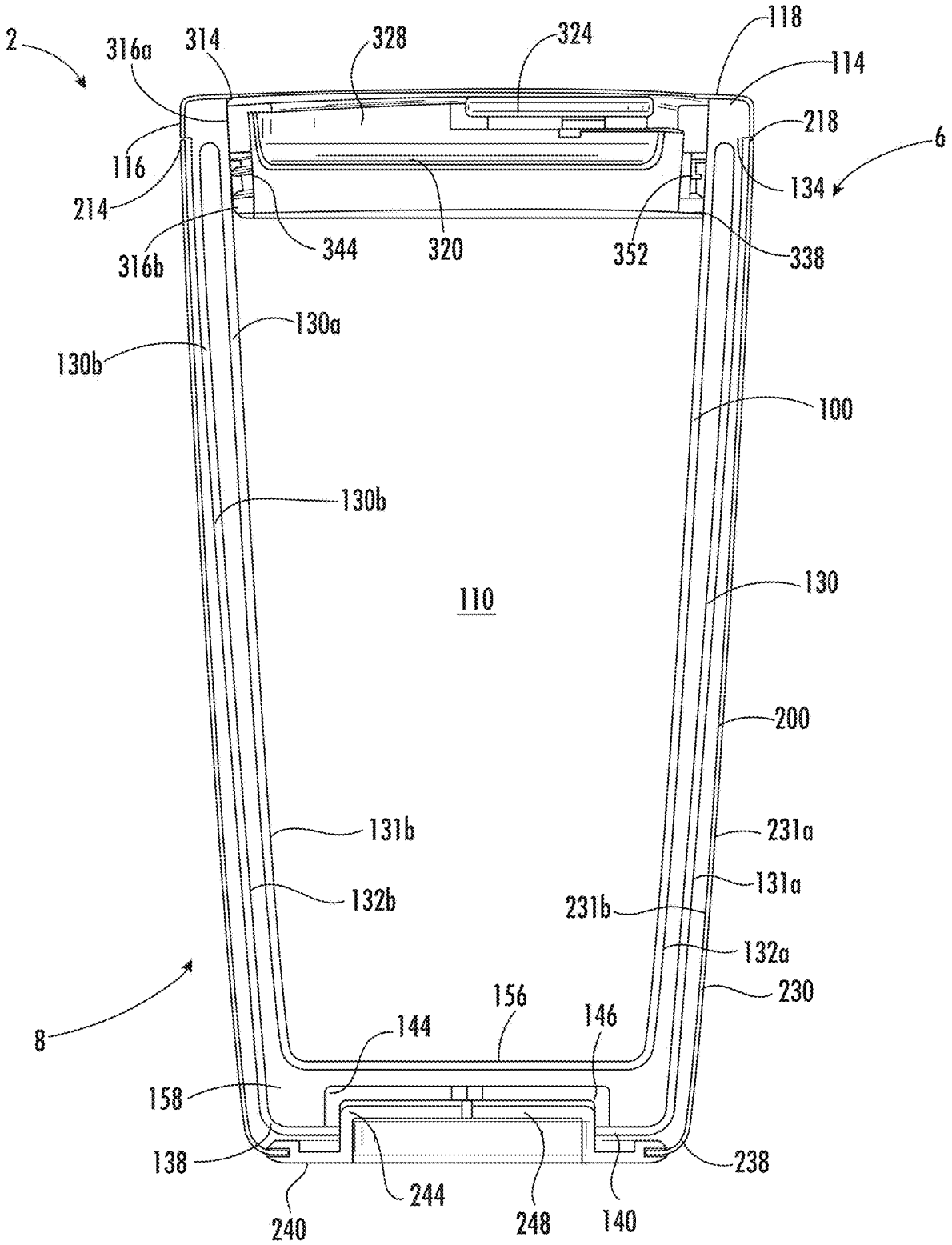
FIG. 9 is a cross-section view of an assembled modular beverage container system including a lid according to various embodiments described herein.

FIG. 9 illustrates a cross-section of the modular beverage container system 2 according to one embodiment. The modular beverage container system 2 includes a vessel 100, shell 200, and lid 300. As shown, the vessel 100, shell 200, and lid 300 are removably coupled in an assembled configuration. The vessel 100 includes a double wall configuration, as described above with respect to FIG. 7. The shell 200 is similar to that described with respect to FIG. 4.

The vessel 100 and shell 200 may be assembled in a manner similar to that described with respect to FIG. 8 or elsewhere herein. As shown, vessel 100 is positioned within the interior volume 210 of the shell 200. Projection 248 of the shell 200 fitting 244 is press fit within hole 146 of the vessel 100 fitting 144 to removably couple the vessel 100 within the interior volume 210 of the shell 200. The inner sidewall 231*b* of the shell 200 is positioned adjacent to the outer sidewall 131*a* of the vessel 100. The upper rim 214 of the shell 200 is positioned adjacent to or is engaged with the upper rim 114 of the vessel 100 along the lip 134. The upper rim 114 of the vessel 100 extends outwardly to position over the upper rim 214 of the shell 200 and is approximately outwardly flush therewith. The upper sidewall 116 of the upper rim 114 of the vessel 100 is exposed along the outer perimeter profile of the assembled modular beverage container system 2. To disassemble the vessel 100 and shell 200, a user may grip the vessel 100 and shell 200 and pull the vessel 100 from the interior volume 210 of the shell 200. Pulling the vessel 100 from the interior volume 210 of the shell 200 with sufficient force overcomes the press fit and removes the projection 248 from the hole 146 and allows the vessel 100 to be removed from the interior volume 210 of the shell 200. When the upper rim 114 of the vessel 100 is positioned above the upper rim 214 of the shell 200 when removably coupled in an assembled configuration, the upper rim 114 of the vessel 100 may provide a region upon which a user may grip the vessel 100 during coupling and uncoupling of the vessel 100 and the shell 200. In some such embodiments, the upper rim 114 may be contoured to provide better grip. In this or another example, the upper rim 114 of the vessel 100 may extend outwardly beyond the upper rim 214 of the shell 200 when the vessel 100 and shell 200 are removably coupled in an assembled configuration.

As described above and elsewhere herein, in some embodiments, the upper rim 114 of the vessel 100 may not include a lip 134. In one such example, the modular beverage container system 2 or vessel 100 and shell 200 thereof may be configured to position the upper rim 114 above, flush with, or below the upper rim 214 of the shell 200 when vessel 100 and shell 200 are removably coupled in an assembled configuration.

The lid 300 illustrated in FIG. 9 may be similar to that described herein with respect to FIG. 6 and may include an upper rim 314 and a lower rim 338. An upper sidewall 316*a* extends from the upper rim 314 and a lower sidewall 316*b* extends from the lower rim 338. A groove 350 is defined along an outer perimeter of the lid 300 between the upper sidewall 316*a* and the lower sidewall 316*b*. A fitting 344 extends within the groove and defines a cross-section dimension slightly larger than a cross-section dimension across the interior volume 110 defined by an interior perimeter of the inner sidewall 131*b*. The fitting 344 comprises a seal gasket 352 including three annular projections 348 defining an outer perimeter of the lid 300, outward of the groove 350. The projections 348 comprise a resiliently compressible elastomeric material such as silicone configured to compress against the inner sidewall 131*b* and provide a friction fit therewith. The engagement of the projections 348 with the inner sidewall 131*b* may removably couple the lid 300 over the interior volume 110 and provide a seal to prevent leakage between the fitting 344 and the wall 130*a*. In some embodiments, greater or fewer projections 348 projections may be used. Projections 348 may also be integral with respect to the lid 300 or may be modular and configured to securely couple within the groove 350 or otherwise.

In some embodiments, the modular beverage container system 2 may utilize other configurations to removably couple the vessel 100 and shell 200. Various example configurations are described below with general reference to FIGS. 2 & 9.

In one example configuration, the vessel 100 and shell 200 include profiles along the outer sidewall 131*a* and inner sidewall 231*b* configured to removably couple. For example, the shell 200 and vessel 100 may include corresponding fittings 144, 244 formed by respective sidewalls 131*a*, 231*b* configured to be press fit. In one example, the shell 200 may include a fitting 244 comprising a hole wherein the hole is defined by the inner sidewall 231*b* and includes all or a portion of the interior volume 210. The vessel 100 may include a fitting 144 comprising the outer sidewall 131*a* wherein all or a portion of an outer perimeter defined by the outer sidewall 131*a* comprises the projection having a cross-section larger than a cross-section of the hole. The projection may include the complete outer perimeter or may include bumps or textured surfaces along the outer sidewall 131*a*. In a further example, one or more projections are positioned along the inner sidewall 231*b* and define a cross-section of the interior volume 210 that is less than a corresponding cross-section defined by a corresponding perimeter of the vessel 131*a* defined by the outer sidewall 131*a* to frictionally engage the outer sidewall 131*a* and press fit the vessel 100 within the interior volume 210 shell of the 200. Thus, the outer perimeter of the vessel 100 and the interior volume 210 of the shell 200 may include cross-sections configured to be press fit in a manner similar to that described above (see, e.g., FIGS. 2, 8 & 9) with respect to the corresponding fittings 144, 244 positioned along the bases 140, 240 of the vessel 100 and shell 200.

In various example configurations, the fittings 144, 244 may comprise threads configured to threadably engage to thereby removably couple the vessel 100 and the shell 200. For example, the outer sidewall 131*a* may include threads positioned to threadably engage corresponding threads positioned along the inner sidewall 231*b*. In a further example, a projection extends from the base 240 of the shell 200, which may be similar in location to projection 248. A corresponding hole may be positioned along the base 140 of the vessel 100, which may be similar in location to hole 146. The projection may define threads around its circumference that correspond to threads defined around the circumference of the sides defining the hole. Thus, the vessel 100 may be positioned within the interior volume 210 of the shell 200 and rotated in a first direction to couple the vessel 100 within the interior volume 200 and subsequently rotated in a second direction to uncouple the vessel 100 from within the interior volume 210.

In some example configurations, the shell 200 may include an actuator configured to actuate a fitting 244 comprising a projection. In one example, the projection may be extendable and retractable relative to the inner sidewall 231*b*, base 240, or other region of the interior volume 210. For example, actuating the projection expand or reduce a dimension or volume of a projection or may extend the projection into the interior volume 210 to compress against the outer sidewall 131*a* of the vessel 100 or within a fitting 144 comprising a slot defined by the sidewall 131*b* or base 140. In a further example, actuating the fitting 244 may extend a projection outward from another projection extending from the base 240, which may be similar in location to projection 248, to compress against one or more sides of a hole along base 140, which may be similar to hole 146, or to be received within a slot formed along a side of the hole. In various embodiments, the projection may be actuated by rotating a knob, flipping a lever, or by pushing a button, for example, that is operatively coupled to the projection.

In various example configurations, the vessel 100 and shell 200 include fittings 144, 244 comprising a slot and a projection receivable through the slot. In one example, the slot extends vertically along inner sidewall 131*b* and is positioned to receive a projection extending from outer sidewall 231*a*. The depth of the slot may decrease from the lower rim 138 toward the upper rim 114 to compress the projection against a base of the slot. In another example, the slot comprises a decreasing width from the lower rim 138 toward the upper rim 114 configured to compress the projection between the width of the slot. In a further example, the projection includes a wedge profile. In another example, the slot may extend vertically and include a horizontal component. For example, the projection may slide vertically through the slot during initial insertion of the vessel 100 or after initial decoupling. The vessel 100 may be rotated when the projection is within the horizontal portion of the slot. For example, the slot may comprise a twist lock configuration wherein the vessel 100 may be rotated in a single plane or through multiple planes, e.g., the slot may include a combination of or combined vertical and horizontal such as an "L", "J", or spline curve. The horizontal component of the slot may be used to improve the coupling of the vessel 100 and the shell 200. In a further example, a projection may extend from another projection that extends from the base 240, which may be similar in location to projection 248. The projection may be received within a slot formed along a side of the hole formed in the base 140 of the vessel 100. The slot may include a twist lock configuration and may include an initial vertical component for receiving and releasing the projection and one or more horizontal components, which may include vertical components, for coupling and uncoupling the vessel. In still another embodiment, the base 240 may include one or more projections positioned to be received within corresponding slots formed in base 140. The slots may include a decreasing width to compress the projections within the width when the vessel 100 is rotated in a first direction and to relieve compression when the vessel is rotated in a second direction to move the projections through an increasing slot width. In another example, wall 230 is resiliently deformable to allow a user to temporally deform the wall 230 to position or remove a projection extending from the outer sidewall 131*b* into or from a slot defined along the inner sidewall 231*a*.

In some example configurations, a fitting 144, 244 includes a piston or diaphragm in fluid communication with the interior volume 210 of the shell 200. For example, the piston or diaphragm may be disposed along outer sidewall 231*a* or base 240. The piston or diaphragm may be actuated to increase the interior volume 210. Thus, when the vessel 100 is received within the interior volume 210, actuation of the piston or diaphragm may increase volume between the vessel 100 and shell 200 to generate a vacuum pressure environment that removably couples the vessel 100 within the interior volume 210. In some examples, the upper rims 114, 214 may be configured to sealingly engage when the vessel 100 is inserted into the interior volume 210. For example, a compressible seal may extend around lip 134 to engage the upper surface 218 of the upper rim 214 of the shell 200. In various embodiments, the piston or diaphragm may be actuated by rotating a knob, flipping a lever, or by pushing a button, for example, that is operatively coupled to the piston or diaphragm. To piston or diaphragm may be similarly actuated, deactuated, or released from actuation in a similar manner to return the interior volume 210 to a previous volume and increase pressure therein to allow removal of the vessel 100 from the interior volume 210.

In some example configurations, the vessel 100 and shell 200 may comprise fittings 144, 244 configured for snap fitment. In another example configuration, the vessel and shell may comprise fittings 144, 244 configured for hook and loop coupling.

It will be appreciated that the various fitting configurations described herein may be reversed with respect to the vessel 100 and shell 200. For example, in one embodiment, a fitting 244 of the shell 200 may define one or more holes configured to receive and thereby press fit with one or more corresponding fittings 144 of the vessel 100 comprising one or more projections. In various embodiments, a fitting 244 of the shell 200 may define one or more holes and one or more projections configured to receive and thereby press fit with one or more corresponding fittings 144 of the vessel 100 comprising one or more projections and one or more holes.

As introduced above with respect to FIG. 1, in some embodiments, the modular beverage container system 2 may include a cap 324. With reference again to FIG. 6, the cap 324 may be selectively slidable with respect to the opening 322 between an open position, as shown, and a closed position wherein the cap 324 is slidable radially outward, toward the upper rim 114, to thereby cover the opening 322 and radially inward, away from the upper rim 114, to thereby uncover the opening 322. In the illustrated embodiment, the cap 324 is recessed with respect to an upper surface 318 of the lid 300. In other embodiments, the cap 324 may be positioned level with or above the upper surface 318.

Figure 10:
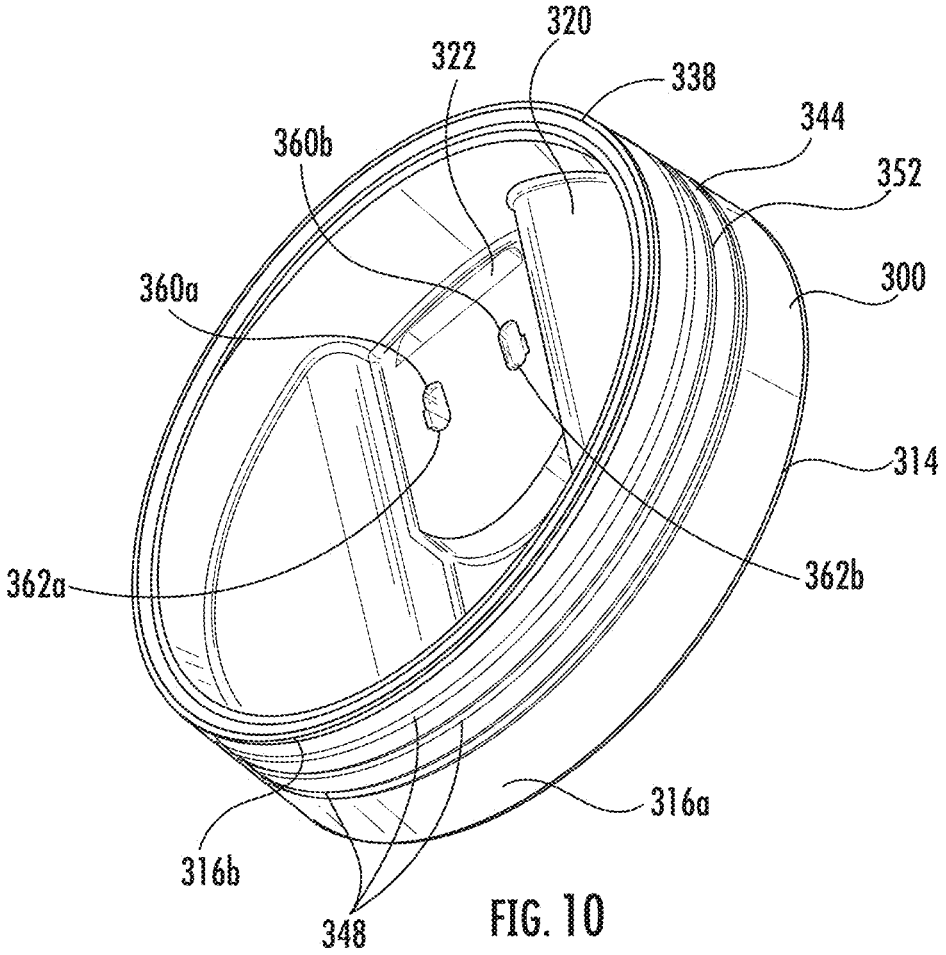
FIG. 10 is a perspective view of a lower end of a lid according to various embodiments described herein.

With further reference to FIG. 10 illustrating a bottom view of a lid 300, the lid 300 defines one or more slots 360*a*, 360*b* into which one or more tabs 362*a*, 362*b* extending from the cap 324 may slidably couple. The one or more slots 360*a*, 360*b* may define the allowed movement of the cap 324 relative to the rest of the lid 300 or opening 322. For example, cap 324 may be urged in a first direction wherein the one or more tabs 362*a*, 362*b* slide through the one or more slots 360*a*, 360*b* in a first direction to cover the opening 322 and transition the cap 324 from the open position to the closed position. The cap 324 may be urged in a second direction wherein the one or more tabs 362*a*, 362*b* slide through the one or more slots 360*a*, 360*b* in a second direction, opposite the first, to uncover the opening 322 and transition the cap 324 from the closed position to the open position. It will be appreciated that in some embodiments, the lid 300 may include one or more tabs that couple within slots defined by the cap 324 to thereby slidably couple the lid 300 and cap 324 in a similar manner.

In some embodiments, other configurations may be used for covering the opening 322. For example, the cap 324 may be slidable through a slot defined by the lid 300 wherein the slot includes tabs or rails that slidably position over an upper surface 318 of the cap 324 or within slots defined along lateral sides of the cap 324. In another example, the cap 324 may be snapped into place over the opening 322 to close the opening 322 and may be removed by lifting the cap 324 from the opening 322. For example, the cap 324 may be press fit into or over the opening 322 in a closed position and pulled from the opening 322 in a closed position. In one example, the cap 324 may be separated from the lid 300 or may be connected to the lid 300 by a strap to prevent the cap 324 from being misplaced in the open position. In a further example, the cap 324 may be coupled to the lid 300 by a hinge along one end allowing another end of the cap 324 to be pivoted upwardly, away from the lid 300, to uncover the opening 322 in an open position and downwardly, toward the opening 322 to position over the opening 322 and thereby cover the opening 322 in a closed position. In a further example, the cap 324 may be coupled to the lid 300 by a hinge or pivot and may be pivoted to rotate the cap 324 within approximately the same major plane as the cap 324 between open and closed positions.

As introduced above, the lid 300 may be configured to removably couple over the interior volume 110 of the vessel 100. The lid 300 may include a fitting 344 configured to assist in removably coupling the lid 300 over the interior volume 110 of the vessel 100. For example, the lid 300 may include projections 348 configured to compress against the inner sidewall 131*b*. The extensions may be integral or modular with respect to the lid 300. For example, as depicted in FIGS. 2 & 9, a lid 300 may include a fitting comprising a seal having one or more projections 348 configured to securely position around the lid 300 and thereon be compressed against a smaller interior cross-section of the inner sidewall 131*b* to press fit the lid 300 within the interior volume 110 of the vessel 100. In a further embodiment, the lid 300 includes a flange that extends over one or both of the upper rims 114, 214 of the vessel 100 and shell 200. In still a further embodiment, the flange includes a skirt portion that further extends around an outer perimeter of one or both walls 130, 230 of the vessel 100 and shell 200. In one example, the skirt may compress against the adjacent outer sidewall 131*a*, 231*b* of the vessel 100 or shell 200 to improve the coupling over the interior volume 110 of the vessel 100.

FIGS. 11-14 illustrate further embodiments of the modular beverage container system 2 and components thereof.

Figure 11:
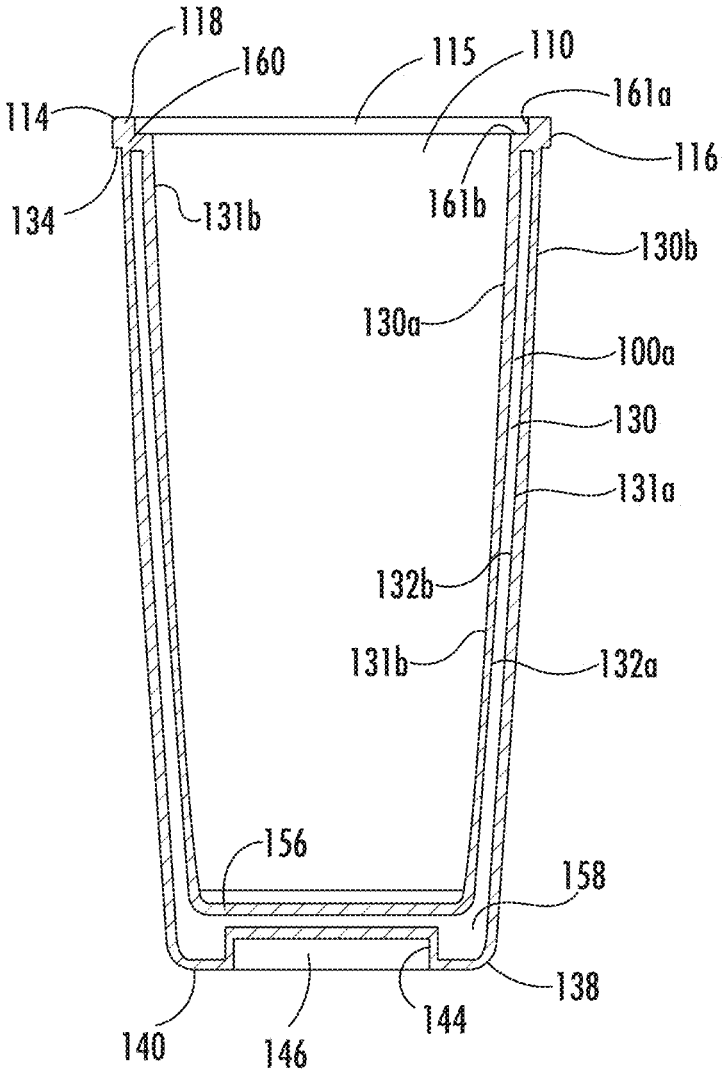
FIG. 11 is a cross-section view of a vessel of a modular beverage container system having a double wall configuration according to various embodiments described herein.

FIG. 11 illustrates a vessel 100*a* according to various embodiments. Vessel 100*a* may be similar to vessel 100 wherein like features are identified by like numbers. It will be appreciated that descriptions provided above and elsewhere herein with respect to vessel 100 may similarly apply to vessel 100*a* and vice versa.

The vessel 100*a* includes a wall 130 defining an interior volume 110. In the illustrated embodiment, the wall 130 includes inner and outer wall 130*a*, 130*b* defining a sealed volume 158 to which a vacuum is maintained as described above. In other embodiments, the wall 130 may not include a double wall configuration or may include insulation material in addition to or instead of a gas situated between two or more walls. The wall 130 extends to an upper rim 114 that extends around an upper perimeter of the vessel 100*a*. The vessel 100*a* may be constructed from one or more materials, such as a glass or other material or combination of materials identified above and elsewhere herein with respect to vessel 100. The upper rim 114 of the vessel 100*a* may comprise a solid material, such as a glass, e.g., as shown in the drawings, or may include a portion of the vacuum sealed space 158.

The vessel 100*a* includes a groove 160 defined along the upper rim 114. The groove 160 is comprises an interiorly positioned recessed rim of the upper rim 114 and may be dimensioned to form a seat for a lip of a lid. The groove 160 includes an interior sidewall 161*a* that extends around an outer perimeter of the groove 160. The interior sidewall 161*a* extends generally vertically from a base 161*b* of the groove 160. The base 161*b* may extend generally horizontally with respect to the conventional orientation of the vessel 100*a*. The base 161*b* and interior sidewall 161*a* are illustrated as having smooth surfaces; however, in some embodiments the base 161*b*, interior sidewall 161*a*, or both may have a textured surface. Textured surfaces may provide friction or surfaces configured to interlock with a lip of a lid.

Figure 12A:
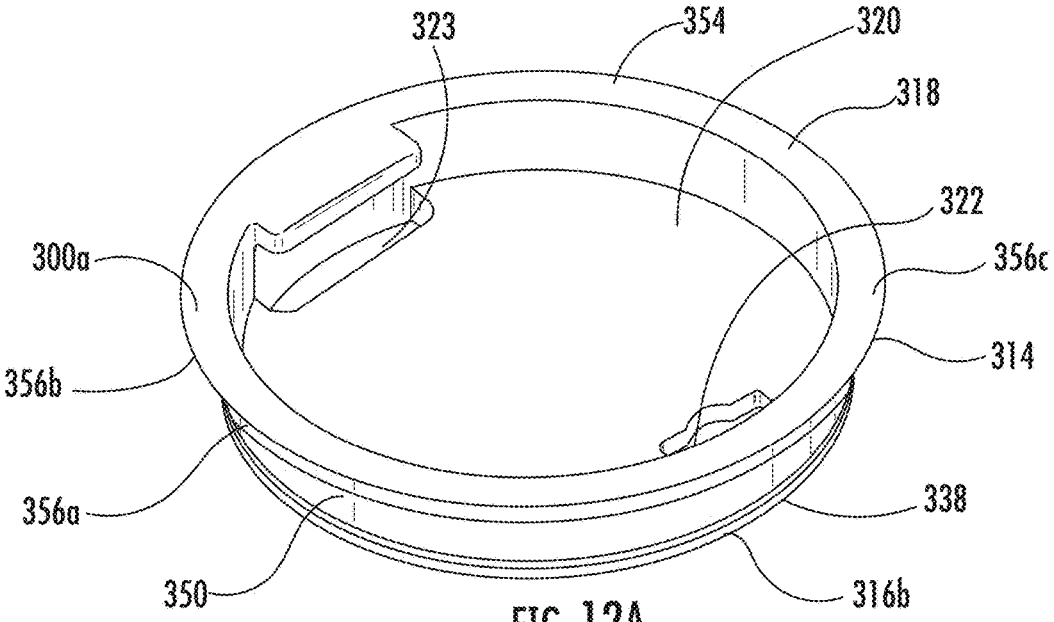
FIG. 12*a* is a perspective view of a lid for a modular beverage container system according to various embodiments described herein.
Figure 12B:
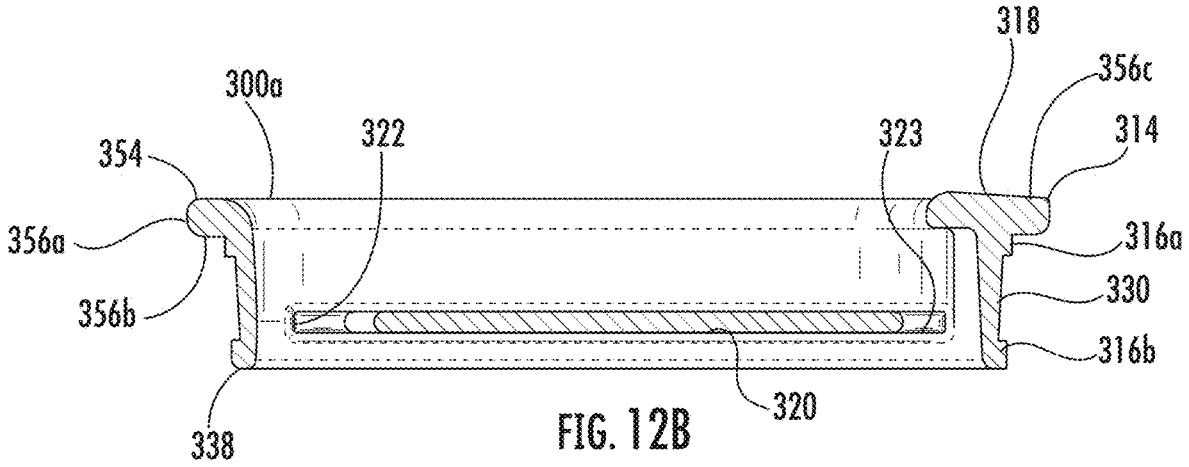
FIG. 12*b* is a cross-section view of the lid shown in FIG. 12*a* according to various embodiments described herein.
Figure 13:
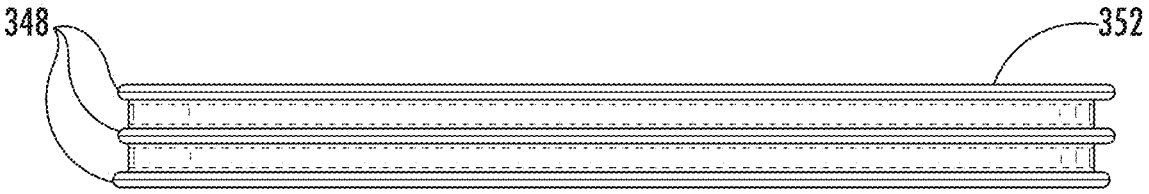
FIG. 13 is an elevated view of a seal gasket for a modular beverage container system according to various embodiments described herein.

FIGS. 12A & 12B illustrate a lid 300*a* according to various embodiments. Lid 300*a* may be similar to lid 300 wherein like features are identified by like numbers. It will be appreciated that descriptions provided above and elsewhere herein with respect to lid 300 may similarly apply to lid 300*a* and vice versa. Lid 300*a* may be configured to removably couple over the interior volume 110 of the vessel 100.

Figure 14:
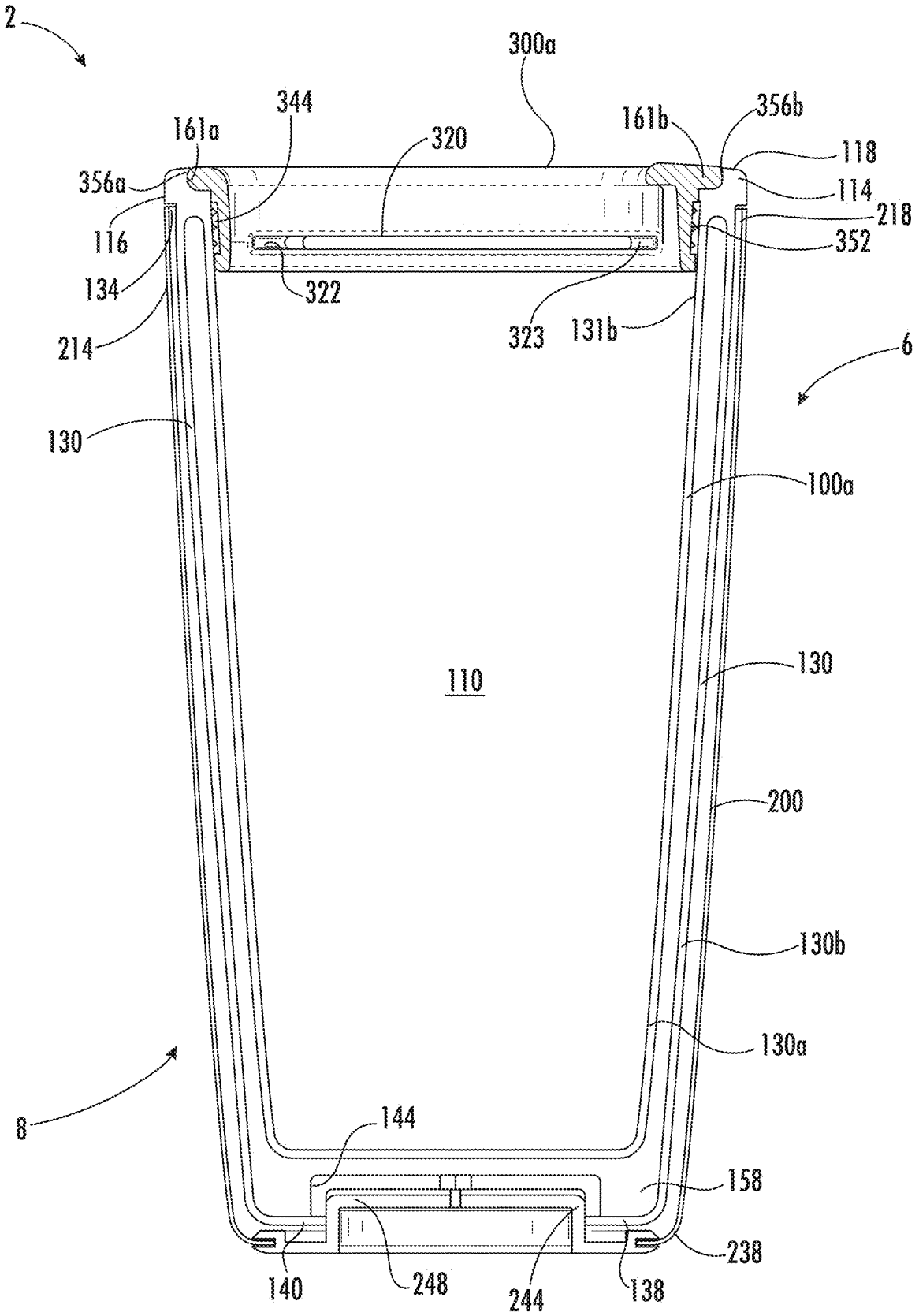
FIG. 14 is a cross-section view of an assembled modular beverage container system including a lid according to various embodiments described herein.

With further reference to FIG. 14, illustrating a cross-section view of an assembled modular beverage container 2 including vessel 100*a* removably received within the interior volume 210 of a shell 200 and including an optional lid 300*a* removably received along the upper rim 114 of the vessel 100*a*, the lid 300*a* may be configured to removably couple along the upper rim 114 of vessel 100*a* to provide an approximately flush fit with the upper surface 118 of the upper rim 114. In other embodiments, lid 300*a* may be configured to be received along the upper rim 114 of the vessel, such as vessel 100 or vessel 100*a*, to provide an approximately flush fit with sidewall 116 of the upper rim 114 or extend outwardly beyond sidewall 116.

The lid 300*a* includes a partition wall 320 for at least partially partitioning the interior volume 115 of a vessel 100, 100*a* from an exterior environment when received therein. The lid 300*a* may also include an upper rim 314 and a lower rim 338. One or more sidewalls 316*a*, 316*b* may extend between the upper rim 314 and lower rim 338. The partition wall 320 defines an opening 322 through which liquid may flow into or out of the interior volume 110 of the vessel 100*a*. The lid 300*a* may also include an air slot 323, which may be defined by the partition wall 320, to allow air to flow into the interior volume 110 of the vessel 100*a* to maintain pressure within the vessel 100*a* suitable for outflow of liquid. In some embodiments, the lid 300*a* may also include a cap (not shown) that is positionable over or through the opening 322 and/or air slot 323 to prevent passage of liquid through the opening 322 or air slot 323. In some embodiments, however, the lid 300*a* does not include an air slot 232, e.g., the opening 322 may be dimensioned to be large enough to allow suitable flow of air during outflow of liquid during drinking.

Assembling the modular beverage container system 2 may include removably coupling the lid 300*a* over the interior volume 110 of the vessel 100*a*. Accordingly, various embodiments of the lid 300*a* may include a fitting 344 (see FIG. 14), configured to assist in removably coupling the lid 300*a* over the interior volume 110 of the vessel 100*a*. For example, the lid 300*a* may include a fitting 344 comprising an outer perimeter having a cross-section slightly larger than a cross-section of an interior perimeter of the vessel 100*a*. The outer perimeter may comprise a resiliently compressible material configured to assist in a friction fit to thereby press fit the fitting 344 within the smaller cross-section of an interior perimeter of the interior volume 110 defined by the inner sidewall 131*b* of the vessel 100*a*. In some embodiments, the interior perimeter of the vessel 100*a* along the inner sidewall 131*b*, the outer perimeter of the fitting 344, or both may include a cross-section that tapers such that the cross-section along a lower portion of the fitting 344 is smaller than a cross-section along an upper portion of the interior perimeter of the interior volume defined by the inner sidewall 131*b* to assist in guiding and thereby compressing the fitting 344 against the sidewall 130 within a smaller lower portion of the interior perimeter of the interior volume defined by the inner sidewall 131*b*. In FIG. 14, the fitting 344 comprises one or more projections 348 defining an outer perimeter of the lid 300*a*. The projections 348 are configured to compress against the interior perimeter of the inner sidewall 131*b* when inserted therebetween. The projections 348 may be integral or modular with respect to the lid 300*a*.

With reference again to FIGS. 12A & 12B, lid 300*a* defines a perimeter groove 350 that opens outwardly and extends around the lid 300*a* between an upper sidewall 316*a* and a lower sidewall 316*b*. The groove 350 may be configured to receive a gasket to form fitting 344. As further shown in FIG. 13, a gasket such as seal gasket 352 may be received within groove 350. The seal gasket 352 includes three annular projections 348 and is dimensioned to be securely positionable within the groove 350 to extend along the outer perimeter of the lid 300*a* and therefrom engage the inner sidewall 131*b* along the interior perimeter of the interior volume 110 to provide a seal therebetween when the fitting 344 is compressed against the sidewall 131*b* of wall 130, e.g., as shown in FIG. 14 and described above with respect to FIGS. 6 & 9. The projections 348 may comprise a resiliently compressible elastomeric material such as silicone configured to provide a friction fit when compressed against the inner sidewall 131*b*. The outer perimeter of the lid 300*a* tapers from the upper sidewall 316*a* toward the lower sidewall 316*b*. In one embodiment, the lid 300*a* does not taper. In some embodiments, a gasket such as seal gasket 352 may be received around a perimeter of the lid 300*a* that does not include a groove 350 or may be received interiorly of the perimeter and extend outwardly through holes in side walls to form fitting 344.

The upper rim 314 of the lid 300*a* may include a lip 354 comprising a flange dimensioned to be received within the recessed groove 160 of the upper rim 114 of the vessel 100*a* (see, e.g., FIGS. 11 & 14). The lip 345 may extend outwardly beyond the upper sidewall 316*a* to define an outer cross-section or diameter greater than an outer cross-section or diameter defined along the upper sidewall 316*a*. The lip 354 may include an outer sidewall 356*a* and an underside wall 356*b*. The outer sidewall 356*a* may extend around the outer perimeter of the lip between an upper wall 356*c* of the lip 354 and underside wall 356*b*. In some embodiments, the upper wall 356*c* partially corresponds to the upper surface 318 of the upper rim 314.

With specific reference to FIG. 14, the modular beverage container system 2 may include a vessel 100*a* configured to be removably received within the interior volume 210 of a shell 200, in a manner similar to that described above and elsewhere herein, and optionally include a lid 300*a* that may be removably received along the upper rim 114 of the vessel 100*a*. It will be appreciated that in some embodiments, the lid 300*a* may be removably received within a deeper portion of the inner volume 110 of the vessel 100*a*. Shell 200 may be similar to shell 200 described elsewhere herein. In the illustrated embodiment, the upper rim 114 positions above the upper rim 214 of the shell 200, exposing sidewall 116 of the upper rim 114 along an upper end 6 of the modular beverage container 2 when assembled. The interior sidewall 161*a* of groove 160 of the upper rim 114 of the vessel 110*a* may define an inner cross-section or diameter corresponding to the outer cross-section or diameter defined by the outer sidewall 356*a* of the lip 354 such that when the lid 300*a* is removably coupled over the interior volume 110 of the vessel 100*a*, the outer cross-section or diameter defined by the outer sidewall 356*a* of the lip 354 corresponds with the inner cross-section or diameter defined by the interior sidewall 161*a* of the groove 160 and the lip 354 is thereby received within the groove 160. In some embodiments, the interior sidewall 161*a* of the groove 160 is configured with a height corresponding to a height of the outer sidewall 356*a* of the lip 354 such that the upper surface 118 of the vessel 100*a* and the upper surface 318 or upper wall 354 of the lid 300*a* are approximately flush when the lid 300*a* is received within the vessel 100*a*. When the lip 354 is received within the groove 160 the underside wall 356*b* of the lip 354 may engage or seat on the base 161*b* of the groove 160. In some embodiments, the distance the underside wall 356*b* extends from the upper sidewall 316*a* approximates the distance the base of the groove extends between the inner sidewall 131*b* and the interior sidewall 161*a*.

Thus, modular beverage container system may include a lid configured to position within the upper rim of the vessel, approximately flush with an upper surface thereof. As described elsewhere herein, some embodiments may include other lid configurations, such as those wherein the lid extends over the upper rim of the vessel, such as vessel 100 or vessel 100*a*, and/or the upper rim of the shell, or upper surfaces thereof, when the modular beverage container system is in an assembled configuration.

Further embodiments may be configured to removably couple the lid over the interior volume and/or create a seal therebetween in additional or alternative ways. In one example configuration, the lid may include a perimeter groove dimensioned to receive the upper rim or an extension thereof of the vessel or shell. In one example, the perimeter groove is defined by the lid such that the opening of the groove is positioned downward to receive an upward extending projection. In some examples, the perimeter groove may be defined along an interior perimeter of the lid, e.g., along an interior portion of the lower rim, such that the opening of the groove is positioned interiorly. In one example, the projection may include a lip that projects outward of an outer most sidewall of the vessel and/or shell when the vessel and shell are coupled such that the projection may be received within the groove when the lid is pressed over the projection. The projection or a lower portion of the lid defining the groove may include resilient elastomeric material to allow the projection to couple and decouple from the groove. In another example, the lid may define an interior dimension corresponding to or slightly less than an outer dimension along the upper end of the modular beverage container system. For example, the lid may define an interior dimension along its lower rim configured to press fit with a slightly larger outer dimension defined by the upper rim of one or both of the vessel or shell. Some examples may include one of the above press fit configurations in addition to or instead of a press fit between the lid and an interior perimeter of the vessel. In various embodiments wherein the lid press fits with the shell, the fitment may removably couple the vessel and shell, which may be in addition to or instead of other manners of removably coupling the vessel and shell described herein.

In various configurations, the lid may include a fitting comprising threads configured to removably couple the lid over the interior volume. For example, the lid may include threads positioned along an outer perimeter configured to threadably engage corresponding threads positioned along an inner sidewall of the vessel or shell. In a further or another example, the lid may include threads positioned along an interior perimeter configured to threadably engage corresponding threads positioned along an outer sidewall of the vessel or shell. In some embodiments, threadably coupling the lid and the shell may also removably couple the vessel and the shell, which may be in addition to or instead of couplings described elsewhere herein. For example, threadably coupling the lid to the outer sidewall may retain and/or compress the vessel against the inner sidewall or base of the shell.

In one embodiment, the modular beverage container system includes a cap that may be positioned over the interior volume of the vessel. The cap may be configured to press fit, thread, or otherwise sealingly engage around the outer perimeter of the vessel or shell. In various embodiments, the cap may be used absent a lid or may be positioned over a lid received by the vessel. In one example, an underside of the cap is configured to cover or insert through openings in a lid to prevent liquid from flowing through the openings when the cap is secured.

As described herein, the shell and vessel may be modular. Thus, a user may remove the vessel for cleaning, heating, or replacement, for example. In some examples, the modular beverage container system may include a plurality of shells and/or vessels wherein the shells and/or vessels are interchangeable. For example, a user may remove the vessel from the shell and replace it with another vessel, e.g., if the vessel has broken. Similarly, a user may remove the vessel from the shell and insert the vessel in another shell. Similarly, in various embodiments, the modular beverage container system includes a modular lid, which may be removed for cleaning or replacement. In one example, a modular beverage container system includes a vessel configured to be received within a plurality of shells. The shells may include different configurations having various contoured exterior forms but defining similar interior volumes to receive the vessel. The modular beverage container system may also include a plurality of interchangeable lids configured to be received within the vessel. Similar to the plurality of shells, the lids may include different contoured exterior forms along the partition plate such as different opening or cap configurations. In some embodiments, the modular beverage container system may include a plurality of interchangeable vessels. The vessels may be configured to provide alternate fitting arrangements with shells or lids. Accordingly, users may select a desired configuration of shell, vessel, or lid. Whether the interchangeable components of the system are configured similarly or different, the modular configuration may allow users to wash components separately or replace damaged or worn components. Similarly, the modular components may be washed separately, e.g., the vessel may be ran through a dishwasher appliance.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth in this specification. Such embodiments may be obtained, for example, by combining, modifying, or reorganizing any of the disclosed steps, components, elements, features, aspects, characteristics, limitations, and the like, of the various non-limiting and non-exhaustive embodiments described in this specification.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an application of the described embodiments. Further, the use of a singular noun includes the plural, and the use of a plural noun includes the singular, unless the context of the usage requires otherwise. Additionally, the grammatical conjunctions "and" and "or" are used herein according to accepted usage. By way of example, "x and y" refers to "x" and "y". On the other hand, "x or y" generally refers to "x", "y", or both "x" and "y", and may be considered to be generally synonymous with "and/or," whereas "either x or y" refers to exclusivity.

The present disclosure may be embodied in other forms without departing from the spirit or essential attributes thereof and, accordingly, reference should be had to the following claims rather than the foregoing specification as indicating the scope of the invention. Further, the illustrations of arrangements described herein are intended to provide a general understanding of the various embodiments, and they are not intended to serve as a complete description. Many other arrangements will be apparent to those of skill in the art upon reviewing the above description. Other arrangements may be utilized and derived therefrom, such that logical substitutions and changes may be made without departing from the scope of this disclosure.

What is claimed is:

1. A modular beverage container system, the system comprising:

a vessel comprising an inner wall, an outer wall, an upper rim, and a sealed volume between the inner wall and the outer wall, the sealed volume at a vacuum pressure, and the inner wall and upper rim defining an interior volume for holding a beverage; and a shell comprising a sidewall having an upper rim defining an interior volume configured to receive the vessel and removably couple thereto.

2. The system of claim 1, wherein the shell and vessel each include a fitting configured to press fit with the other when the vessel is received within the interior volume of the shell to removably couple the vessel within the interior volume of the shell.

3. The system of claim 2, wherein one of the fittings comprises a hole and the other fitting comprises a projection dimensioned to press fit within the hole.

4. The system of claim 2, wherein the vessel fitting comprises a hole and the shell fitting comprises a projection dimensioned to press fit within the hole.

5. The system of claim 1, wherein, when the vessel and shell are removably coupled, the upper rim of the vessel is positioned above the upper rim of the shell and extends outwardly beyond the interior volume of the shell defined by the upper rim of the shell.

6. The system of claim 5, wherein the upper rim of the vessel includes an outer sidewall, and wherein, when the vessel and shell are removably coupled, the outer sidewall positions above the upper rim of the shell and outward of the interior volume of the shell defined by the upper rim of the shell.

7. The system of claim 6, wherein, when the vessel and shell are removably coupled, the sidewall positions approximately flush with an outer sidewall of the shell.

8. The system of claim 5, wherein the upper rim of the vessel includes a lip, and wherein, when the vessel and shell are removably coupled, the lip of the vessel positions over an upper surface of the upper rim of the shell.

9. The system of claim 8, wherein the upper rim of the vessel includes an outer sidewall extending around the upper rim between an upper surface of the upper rim and the lip of the vessel, and wherein, when the vessel and shell are removably coupled, the outer sidewall of the vessel positions approximately flush with an outer sidewall of the shell.

10. The system of claim 1, wherein the vessel comprises a glass and the shell comprises stainless steel.

11. The system of claim 1, further comprising a lid configured to removably couple over the interior volume of the vessel.

12. The system of claim 11, wherein the lid includes a fitting configured to press fit against an inner sidewall of the inner wall of the vessel to removably couple within the interior volume of the vessel.

13. The system of claim 12, wherein, when the lid is removably coupled within the interior volume of the vessel, an upper surface of the upper rim of the lid positions approximately flush with or below an upper surface of the upper rim of the vessel.

14. A method of assembling a modular beverage container, the method comprising:

inserting a vessel within an interior volume of a shell, wherein the vessel and shell each include a fitting configured to press fit with the other; and removably coupling the vessel within the interior volume of the shell by press fitting the corresponding fittings of the vessel and shell, wherein the vessel comprises an inner wall defining an interior volume for holding a beverage, an outer sidewall, and a sealed volume between the inner wall and the outer wall, and wherein the sealed volume is at a vacuum pressure.

15. The method of claim 14, wherein one of the fittings comprises a hole and the other fitting comprises a projection dimensioned to press fit within the hole.

16. The method of claim 14, wherein the vessel has an upper rim including an outer sidewall, and wherein, when the vessel and shell are removably coupled, the outer sidewall is positioned above an upper rim of the shell and extends outwardly of a portion of the interior volume of the shell defined by the upper rim of the shell.

17. The method of claim 16, wherein the upper rim of the vessel includes a lip, and wherein, when the vessel and shell are removably coupled, the lip positions over an upper surface of the upper rim of the shell and the outer sidewall positions approximately flush with an outer sidewall of the shell.

18. The method of claim 14, wherein the vessel comprises a glass and the shell comprises stainless steel.

19. The method of claim 14, further comprising inserting a lid within the interior volume of the vessel and removably coupling the lid therein, wherein the lid and vessel each include an upper rim having an upper surface, and wherein, when the lid is removably coupled within the interior volume of the vessel, the upper surface of the upper rim of the lid positions approximately flush with or below the upper surface of the upper rim of the vessel.

20. A modular beverage container system, the system comprising:

a glass vessel comprising an inner wall, an outer sidewall, an upper rim having an outer sidewall, and a sealed volume between at least the inner wall and the outer wall, the sealed volume at a vacuum pressure, and the inner wall and upper rim defining an interior volume for holding a beverage;

a rigid shell comprising a sidewall including an upper rim and defining an interior volume therebetween configured to receive the vessel and removably couple thereto, wherein the shell and vessel each include a fitting configured to press fit with the other when the vessel is received within the interior volume of the shell to removably couple the vessel within the interior volume of the shell, and wherein, when the vessel and shell are removably coupled, the outer sidewall of the upper rim of the vessel positions above the upper rim of the shell and approximately flush with an outer sidewall of the shell; and a lid configured to removably couple within the interior volume of the vessel, the lid comprising an upper rim having an upper surface, and wherein, when the lid is removably coupled within the interior volume of the vessel, the upper surface of the upper rim of the lid positions approximately flush with or below the upper surface of the upper rim of the vessel.

* * * * *